US006984082B2

(12) United States Patent
Endo

(10) Patent No.: US 6,984,082 B2
(45) Date of Patent: Jan. 10, 2006

(54) PRINTER, METHOD FOR DETERMINING TOP EDGE OF OBJECT TO BE PRINTED, METHOD FOR DETERMINING BOTTOM EDGE OF OBJECT TO BE PRINTED, COMPUTER PROGRAM, AND COMPUTER SYSTEM

(75) Inventor: Hironori Endo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/491,984

(22) PCT Filed: Feb. 18, 2003

(86) PCT No.: PCT/JP03/01727

§ 371 (c)(1),
(2), (4) Date: Apr. 7, 2004

(87) PCT Pub. No.: WO03/070473

PCT Pub. Date: Aug. 28, 2003

(65) Prior Publication Data

US 2004/0247364 A1 Dec. 9, 2004

(30) Foreign Application Priority Data

Feb. 21, 2002 (JP) ..... 2002-045206
Feb. 26, 2002 (JP) ..... 2002-050348

(51) Int. Cl.
*B41J 11/42* (2006.01)

(52) U.S. Cl. ..... 400/579; 400/578; 400/708

(58) Field of Classification Search ..... 400/578–579, 400/279, 283, 582, 705.1, 708; 347/14, 19
See application file for complete search history.

(56) References Cited

U.S. PATENT DOCUMENTS

| | | | | |
|---|---|---|---|---|
| 5,127,752 | A | 7/1992 | Courtney | |
| 5,397,192 | A | 3/1995 | Khormaee | |
| 6,305,856 | B1 | 10/2001 | Miyazaki | |
| 6,348,697 | B1 * | 2/2002 | Kitajima | 250/559.4 |
| 6,390,703 | B1 * | 5/2002 | Kinas et al. | 400/708 |
| 6,834,929 | B1 * | 12/2004 | Adams et al. | 347/19 |
| 2004/0028450 | A1 * | 2/2004 | Jung | 400/709 |

FOREIGN PATENT DOCUMENTS

| | | | |
|---|---|---|---|
| EP | 0526154 | A2 * | 2/1993 |
| JP | 2-231343 | A | 9/1990 |
| JP | 2-255360 | A | 10/1990 |

(Continued)

*Primary Examiner*—Minh Chau
(74) *Attorney, Agent, or Firm*—Sughrue Mion, PLLC

(57) ABSTRACT

A printing apparatus comprises feeding means, light-emitting means, and a light-receiving sensor, and is capable of detecting a change in an output value of the light-receiving sensor that is caused by the medium to be printed, which has been fed by the feeding means, blocking the light, which has been emitted by the light-emitting means, wherein, by moving the light-emitting means and the light-receiving sensor in a main scanning direction, the printing apparatus detects, at a plurality of positions, changes in the output value that are caused by an upper or lower edge of the medium to be printed blocking the light, and based on a result of the detection, the printing apparatus obtains a position, in the feeding direction, of either one of a left edge or a right edge of the upper or lower edge that is fed leading or trailing the other in the feeding direction.

31 Claims, 22 Drawing Sheets

FOREIGN PATENT DOCUMENTS

| | | | |
|---|---|---|---|
| JP | 4-189239 | A | 7/1992 |
| JP | 5-58012 | A | 3/1993 |
| JP | 8-80609 | A | 3/1996 |
| JP | 10-291689 | A | 11/1998 |
| JP | 11-116100 | A | 4/1999 |
| JP | 2000-118058 | A | 4/2000 |

* cited by examiner

PRINTER, METHOD FOR DETERMINING TOP EDGE OF OBJECT TO BE PRINTED, METHOD FOR DETERMINING BOTTOM EDGE OF OBJECT TO BE PRINTED, COMPUTER PROGRAM, AND COMPUTER SYSTEM

TECHNICAL FIELD

The present invention relates to printing apparatuses, methods for determining an upper edge of a medium to be printed, methods for determining a lower edge of a medium to be printed, computer programs, and computer systems.

BACKGROUND ART

Color inkjet printers, which are typical printing apparatuses, are already well known. The color inkjet printer has an inkjet type print head for discharging ink from nozzles and is structured to record images, letters, and the like by making ink droplets land onto print paper, which is an example of a printing medium.

Further, the print head is supported on a carriage which is an example of a movable moving member and which is provided with the print head in such a state that a nozzle surface in which the nozzles are formed opposes the print paper, and the print head moves (performs main scanning) in a width direction of the print paper along a guide member and ejects ink in synchronism with the main-scanning.

Further, in recent years, color inkjet printers capable of performing so-called borderless printing in which printing is performed on the whole surface of print paper are gaining popularity for reasons such as that image output results that are the same as photographs can be achieved. With borderless printing, for example, it is possible to perform printing by ejecting ink at the four edges of the print paper with no margins.

=Upper Edge=

It is necessary to accurately ascertain the position of the print paper in order to carry out precise printing at the positions in which dots should be formed on the print paper. One procedure for achieving this is to have the printing apparatus ascertain the position of the upper edge of the print paper.

Several methods have been proposed for ascertaining the position of the upper edge of the print paper, and one of these methods is to emit light from a light-emitting diode or the like, and then to ascertain the position of the upper edge by detecting a change in the output value of a light-receiving sensor such as a photodiode (hereafter, also referred to as a light receiving section) caused by the print paper, which is being fed, blocking the light.

There are cases, however, in which the print paper is supplied (or fed) in a skewed (diagonal) manner; therefore, strictly speaking, the position of the upper edge that has been ascertained by the above-mentioned method may not be the most leading position in the paper feed direction, and a problem may occur with regard to the precision with which the printing apparatus ascertains the upper edge position.

In particular, in the case of borderless printing, it is necessary to accurately ascertain the position of the upper edge of the print paper since printing is carried out on the upper edge of the print paper as well, and if the upper edge position cannot be ascertained accurately, a problem may occur such as a blank portion appearing on an upper portion of the print paper that has been printed. Furthermore, if printing is carried out by enlarging the print area and providing a margin in order to avoid such a problem, then problems such as consumption of excessive ink may occur.

=Lower Edge=

As described above, it is necessary to accurately ascertain the position of the print paper in order to carry out precise printing at the positions in which dots should be formed on the print paper. One procedure for achieving this is to have the printing apparatus ascertain the position of the lower edge of the print paper.

Several methods have been proposed for ascertaining the position of the lower edge of the print paper, and one of these methods is to emit light from a light-emitting diode or the like, and then to ascertain the position of the lower edge by detecting a change in the output value of a light-receiving sensor such as a photodiode (hereafter, also referred to as a light receiving section) caused by the print paper, which is being fed, blocking the light.

There are cases, however, in which the print paper is supplied (or fed) in a skewed (diagonal) manner; therefore, strictly speaking, the position of the lower edge that has been ascertained by the above-mentioned method may not be the most trailing position in the paper feed direction, and a problem may occur with regard to the precision with which the printing apparatus ascertains the lower edge position.

In particular, in the case of borderless printing, it is necessary to accurately ascertain the position of the lower edge of the print paper since printing is carried out on the lower edge of the print paper as well, and if the lower edge position cannot be ascertained accurately, a problem may occur such as a blank portion appearing on an lower portion of the print paper that has been printed. Furthermore, if printing is carried out by enlarging the print area and providing a margin in order to avoid such a problem, then problems such as consumption of excessive ink may occur.

The present invention has been made in view of the foregoing issues, and it is an object thereof to achieve a printing apparatus, a method for determining an upper edge of a medium to be printed, a computer program, and a computer system that are capable of ascertaining, with good precision, the position of an upper edge of a medium to be printed. A further object of the present invention is to achieve a printing apparatus, a method for determining a lower edge of a medium to be printed, a computer program, and a computer system that are capable of ascertaining, with good precision, the position of a lower edge of a medium to be printed.

DISCLOSURE OF INVENTION

A primary aspect of the present invention is a printing apparatus comprising: feeding means for feeding, in a predetermined feeding direction, a medium to be printed that has been supplied; light-emitting means for emitting light; and a light-receiving sensor for receiving light emitted by the light-emitting means, the printing apparatus being capable of detecting a change in an output value of the light-receiving sensor that is caused by the medium to be printed, which has been fed by the feeding means, blocking the light, which has been emitted by the light-emitting means, wherein, by moving the light-emitting means and the light-receiving sensor in a main scanning direction, the printing apparatus detects, at a plurality of positions, changes in the output value that are caused by an upper edge of the medium to be printed blocking the light, and based on a result of the detection, the printing apparatus obtains a position, in the feeding direction, of either one of a left edge or a right edge of the upper edge that is fed leading the other in the feeding direction.

Further, another primary aspect of the present invention is a printing apparatus comprising: feeding means for feeding, in a predetermined feeding direction, a medium to be printed that has been supplied; light-emitting means for emitting light; and a light-receiving sensor for receiving light emitted by the light-emitting means, the printing apparatus being capable of detecting a change in an output value of the light-receiving sensor that is caused by the medium to be printed, which has been fed by the feeding means, blocking the light, which has been emitted by the light-emitting means, wherein the printing apparatus detects, at a plurality of positions, changes in the output value that are caused by a lower edge of the medium to be printed blocking the light, and based on a result of the detection, obtains a position, in the feeding direction, of either one of a left edge or a right edge of the lower edge that is fed trailing the other in the feeding direction.

Features of the present invention other than the above will become clearer through the accompanying drawings and the discussion of the present description.

Figure 1:
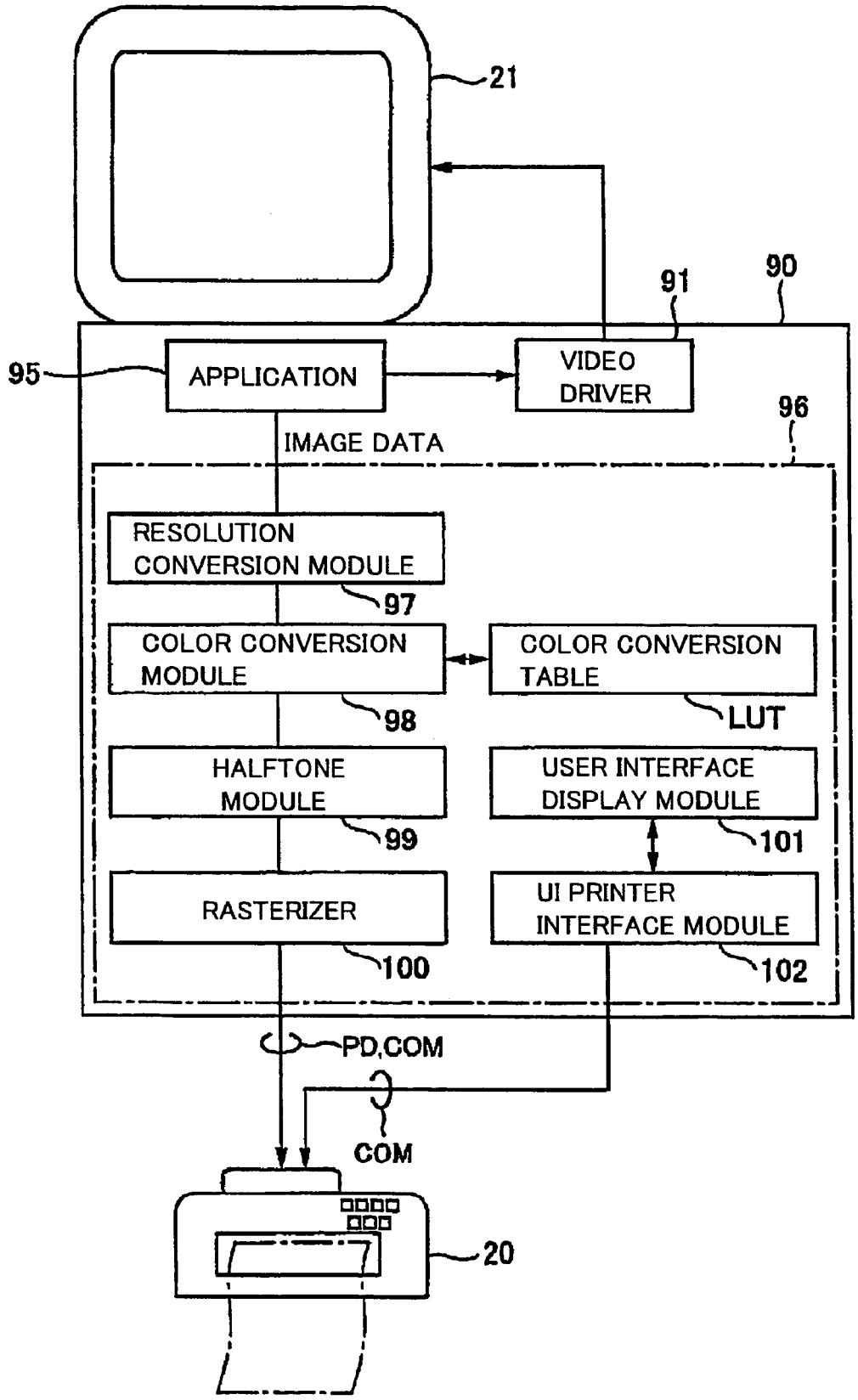
FIG. 1 is a block diagram showing a configuration of a printing system as one example of the present invention.

A legend of the main reference characters used in the drawings is described below:

| | | | |
|---|---|---|---|
| 11 | linear encoder | 12 | linear encoder code plate |
| 13 | rotary encoder | 14 | rotary encoder code plate |
| 20 | color inkjet printer | 21 | CRT |
| 22 | paper stacker | 24 | paper feed roller |
| 25 | pulley | 26 | platen |
| 28 | carriage | 29 | reflective optical sensor |
| 30 | carriage motor | 31 | paper feed motor |
| 32 | pull belt | 34 | guide rail |
| 36 | print head | 38 | light emitting section |
| 40 | light receiving section | 50 | buffer memory |
| 52 | image buffer | 54 | system controller |
| 56 | main memory | 58 | EEPROM |
| 61 | main-scan drive circuit | 62 | sub-scan drive circuit |
| 63 | head drive circuit | | |
| 65 | reflective optical sensor control circuit | | |
| 66 | electric signal measuring section | 90 | computer |
| 91 | video driver | 95 | application program |
| 96 | printer driver | 97 | resolution conversion module |
| 98 | color conversion module | 99 | halftone module |
| 100 | rasterizer | | |
| 101 | user interface display module | | |
| 102 | UI printer interface module | | |
| 1011 | linear encoder | | |
| 1012 | linear encoder code plate | | |
| 1013 | rotary encoder | | |
| 1014 | rotary encoder code plate | | |
| 1020 | color inkjet printer | | |
| 1021 | CRT | 1022 | paper stacker |
| 1024 | paper feed roller | 1025 | pulley |
| 1026 | platen | 1028 | carriage |
| 1029 | reflective optical sensor | 1030 | carriage motor |
| 1031 | paper feed motor | 1032 | pull belt |
| 1034 | guide rail | 1036 | print head |
| 1038 | light emitting section | 1040 | light receiving section |
| 1050 | buffer memory | 1052 | image buffer |
| 1054 | system controller | 1056 | main memory |
| 1058 | EEPROM | 1061 | main-scan drive circuit |
| 1062 | sub-scan drive circuit | 1063 | head drive circuit |
| 1065 | reflective optical sensor control circuit | | |
| 1066 | electric signal measuring section | | |
| 1090 | computer | | |
| 1091 | video driver | 1095 | application program |
| 1096 | printer driver | | |
| 1097 | resolution conversion module | | |
| 1098 | color conversion module | | |
| 1099 | halftone module | | |
| 1100 | rasterizer | | |
| 1101 | user interface display module | | |
| 1102 | UI printer interface module | | |

BEST MODE FOR CARRYING OUT THE INVENTION

First Embodiment

At least the following matters will be made clear by the explanation in the present specification and the description of the accompanying drawings.

A printing apparatus comprises: feeding means for feeding, in a predetermined feeding direction, a medium to be printed that has been supplied; light-emitting means for emitting light; and a light-receiving sensor for receiving light emitted by the light-emitting means, the printing apparatus being capable of detecting a change in an output value of the light-receiving sensor that is caused by the medium to be printed, which has been fed by the feeding means, blocking the light, which has been emitted by the light-emitting means, wherein, by moving the light-emitting means and the light-receiving sensor in a main scanning direction, the printing apparatus detects, at a plurality of positions, changes in the output value that are caused by an upper edge of the medium to be printed blocking the light, and based on a result of the detection, the printing apparatus obtains a position, in the feeding direction, of either one of a left edge or a right edge of the upper edge that is fed leading the other in the feeding direction.

By detecting, at a plurality of positions, the changes in the output value that are caused by the upper edge of the medium to be printed blocking the light by moving the light-emitting means and the light-receiving sensor in the main scanning direction, and obtaining the position, in the feeding direction, of either one of the left edge or the right edge of the upper edge that is fed leading the other in the feeding direction based on a result of the detection, it is possible to precisely ascertain the position of the upper edge of the medium to be printed with a minimum of a light-emitting means and a light-receiving sensor.

It is also possible to eject ink from a print head to form dots on the medium to be printed.

As high quality printing results are particularly demanded of so-called inkjet printing apparatuses, which carry out printing by ejecting ink from a print head, the advantages of the above-described procedure become greater.

It is also possible to detect, at a first position and a second position which are different from each other in the main scanning direction, the changes in the output value that are caused by the upper edge of the medium to be printed blocking the light; and to obtain the position of either one of the left edge or the right edge of the upper edge that is fed leading the other in the feeding direction based on a position, in the main scanning direction, of the first position, a position, in the main scanning direction, of the second position, and an amount of the medium to be printed fed from when a change in the output value is detected at the first position until when a change in the output value is detected at the second position.

Doing this allows the number of times for detecting the changes in the output value of the light-receiving sensor to be minimized, and the procedure can be simplified.

It is also possible to move the light-emitting means and the light-receiving sensor either upstream or downstream in the main scanning direction from the first position after the change in the output value is detected at the first position; and, according to the output value of the light-receiving sensor that has received light emitted by the light-emitting means, to set the second position on an opposite side, with respect to the first position, from the side where the determination was made if it is determined that the light is incident on the medium to be printed, and to set the second position on a same side, with respect to the first position, as the side where the determination was made if it is determined that the light is not incident on the medium to be printed.

Doing this allows the inconvenience of having to feed the medium to be printed backwards to be avoided.

It is also possible that the light-emitting means and the light-receiving sensor are provided on a movable moving member that is provided with a print head for forming dots.

Doing this allows the moving mechanisms of the moving member, the light emitting section, and the light receiving section to be shared.

It is also possible to carry out printing on the medium to be printed after feeding the medium to be printed so that either one of the left edge or the right edge of the upper edge that is fed leading the other in the feeding direction reaches a predetermined position.

Doing this allows printing to be carried out precisely in the position where dots should be formed on the medium to be printed.

It is also possible to carry out printing with respect to an entire surface of the medium to be printed.

In the case of carrying out printing with respect to an entire surface of the medium to be printed, it is necessary to accurately ascertain the position of the upper edge of the medium to be printed since printing is carried out also on the upper edge of the medium to be printed; therefore, the advantages of the above-described procedure become greater.

Further, a printing apparatus comprises: feeding means for feeding, in a predetermined feeding direction, a medium to be printed that has been supplied; light-emitting means for emitting light; and a light-receiving sensor for receiving light emitted by the light-emitting means, the printing apparatus being capable of detecting a change in an output value of the light-receiving sensor that is caused by the medium to be printed, which has been fed by the feeding means, blocking the light, which has been emitted by the light-emitting means, wherein: the light-emitting means and the light-receiving sensor are provided on a movable moving member that is provided with a print head for ejecting ink to form dots; by moving the light-emitting means and the light-receiving sensor in a main scanning direction, the printing apparatus detects, at a first position and a second position which are different from each other in the main scanning direction, changes in the output value that are caused by an upper edge of the medium to be printed blocking the light; the printing apparatus obtains the position of either one of a left edge or a right edge of the upper edge that is fed leading the other in the feeding direction based on a position, in the main scanning direction, of the first position, a position, in the main scanning direction, of the second position, and an amount of the medium to be printed fed from when a change in the output value is detected at the first position until when a change in the output value is detected at the second position; after the change in the output value is detected at the first position, the printing apparatus moves the light-emitting means and the light-receiving sensor either upstream or downstream in the main scanning direction from the first position, and, according to the output value of the light-receiving sensor that has received light emitted by the light-emitting means, if it is determined that the light is incident on the medium to be printed, then the printing apparatus sets the second position on an opposite side, with respect to the first position, from the side where the determination was made, and if it is determined that the light is not incident on the medium to be printed, then the printing apparatus sets the second position on a same side, with respect to the first position, as the side where the determination was made; and the printing apparatus carries out printing with respect to an entire surface of the medium to be printed by ejecting ink from the print head after feeding the medium to be printed so that either one of the left edge or the right edge of the upper edge that is fed leading the other in the feeding direction reaches a predetermined position.

Doing this allows all of the above-described effects to be achieved, and therefore, the objects of the present invention are most effectively achieved.

Furthermore, in a method for determining an upper edge of a medium to be printed with a printing apparatus that is provided with: feeding means for feeding, in a predetermined feeding direction, a medium to be printed that has been supplied; light-emitting means for emitting light; and a light-receiving sensor for receiving light emitted by the light-emitting means, the printing apparatus being capable of detecting a change in an output value of the light-receiving sensor that is caused by the medium to be printed, which has been fed by the feeding means, blocking the light, which has been emitted by the light-emitting means, the method for determining the upper edge of the medium to be printed comprises: a step of detecting, at a plurality of positions, changes in the output value that are caused by the upper edge of the medium to be printed blocking the light by moving the light-emitting means and the light-receiving sensor in a main scanning direction; and a step of obtaining a position, in the feeding direction, of either one of a left edge or a right edge of the upper edge that is fed leading the other in the feeding direction, based on a result of the detection.

By detecting, at a plurality of positions, the changes in the output value that are caused by the upper edge of the medium to be printed blocking the light by moving the light-emitting means and the light-receiving sensor in the main scanning direction, and obtaining the position, in the feeding direction, of either one of the left edge or the right edge of the upper edge that is fed leading the other in the feeding direction based on a result of the detection, it is possible to precisely ascertain the position of the upper edge of the medium to be printed with a minimum of a light-emitting means and a light-receiving sensor.

Furthermore, it is also possible to achieve a computer program for causing a printing apparatus to execute the above-described method that exhibits the above-described effects of being able to precisely ascertain the position of the upper edge of the medium to be printed with a minimum of a light-emitting means and a light-receiving sensor.

Furthermore, a computer system comprises: a computer unit; and a printing apparatus that is connectable to the computer unit, the printing apparatus being provided with: feeding means for feeding, in a predetermined feeding direction, a medium to be printed that has been supplied; light-emitting means for emitting light; and a light-receiving sensor for receiving light emitted by the light-emitting means, and the printing apparatus being capable of detecting a change in an output value of the light-receiving sensor that is caused by the medium to be printed, which has been fed by the feeding means, blocking the light, which has been emitted by the light-emitting means, wherein, by moving the light-emitting means and the light-receiving sensor in a main scanning direction, the printing apparatus detects, at a plurality of positions, changes in the output value that are caused by an upper edge of the medium to be printed blocking the light, and based on a result of the detection, the printing apparatus obtains a position, in the feeding direction, of either one of a left edge or a right edge of the upper edge that is fed leading the other in the feeding direction.

A computer system achieved in this way becomes superior to conventional systems as an overall system.

Example of Overall Configuration of the Apparatus

FIG. 1 is a block diagram showing the configuration of a printing system serving as an example of the present invention. The printing system is provided with a computer 90 and a color inkjet printer 20, which is an example of a printing apparatus. It should be noted that the printing system including the color inkjet printer 20 and the computer 90 can also be broadly referred to as a "printing apparatus." Although not shown in the figure, a computer system is made of the computer 90, the color inkjet printer 20, a display device such as a CRT 21 or a liquid crystal display device, input devices such as a keyboard and a mouse, and a drive device such as a flexible drive device or a CD-ROM drive device.

In the computer 90, an application program 95 is executed under a predetermined operating system. The operating system includes a video driver 91 and a printer driver 96, and the application program 95 outputs print data PD to be transferred to the color inkjet printer 20 through these drivers. The application program 95, which carries out retouching of images, for example, carries out a desired process with respect to an image to be processed, and also displays the image on the CRT 21 via the video driver 91.

When the application program 95 issues a print command, the printer driver 96 of the computer 90 receives image data from the application program 95 and converts these into print data PD to be supplied to the color inkjet printer 20. The printer driver 96 is internally provided with a resolution conversion module 97, a color conversion module 98, a halftone module 99, a rasterizer 100, a user interface display module 101, a UI printer interface module 102, and a color conversion look-up table LUT.

The resolution conversion module 97 performs the function of converting the resolution of the color image data formed by the application program 95 to a print resolution. The image data whose resolution is thus converted is image information still made of the three color components RGB. The color conversion module 98 refers to the color conversion look-up table LUT and, for each pixel, converts the RGB image data into multi-gradation data of a plurality of ink colors that can be used by the color inkjet printer 20.

The multi-gradation data that have been color converted have a gradation value of 256 levels, for example. The halftone module 99 executes so-called halftone processing to generate halftone image data. The halftone image data are rearranged by the rasterizer 100 into the order in which they are to be transferred to the color inkjet printer 20, and are output as the final print data PD. The print data PD include raster data indicating the state in which dots are formed during each main scan movement, and data indicating the sub-scanning feed amount.

The user interface display module 101 has a function for displaying various types of user interface windows related to printing and a function for receiving input from the user in these windows.

The UI printer interface module 102 has a function as an interface between the user interface (UI) and the color inkjet printer. It interprets instructions given by users through the user interface and sends various commands COM to the color inkjet printer, and conversely, it also interprets commands COM received from the color inkjet printer and executes various displays with respect to the user interface.

It should be noted that the printer driver 96 achieves, for example, a function for sending and receiving various types of commands COM and a function for supplying print data PD to the color inkjet printer 20. A program for realizing the functions of the printer driver 96 is supplied in a format in which it is stored on a computer-readable storage medium. Various kinds of computer-readable media, such as flexible disks, CD-ROMS, magneto optical disks, IC cards, ROM cartridges, punch cards, printed materials on which a code is printed such as a bar code, and internal storage devices (memory such as a RAM or a ROM) and external storage devices of the computer can be used. The computer program can also be downloaded onto the computer 90 via the Internet.

Figure 2:
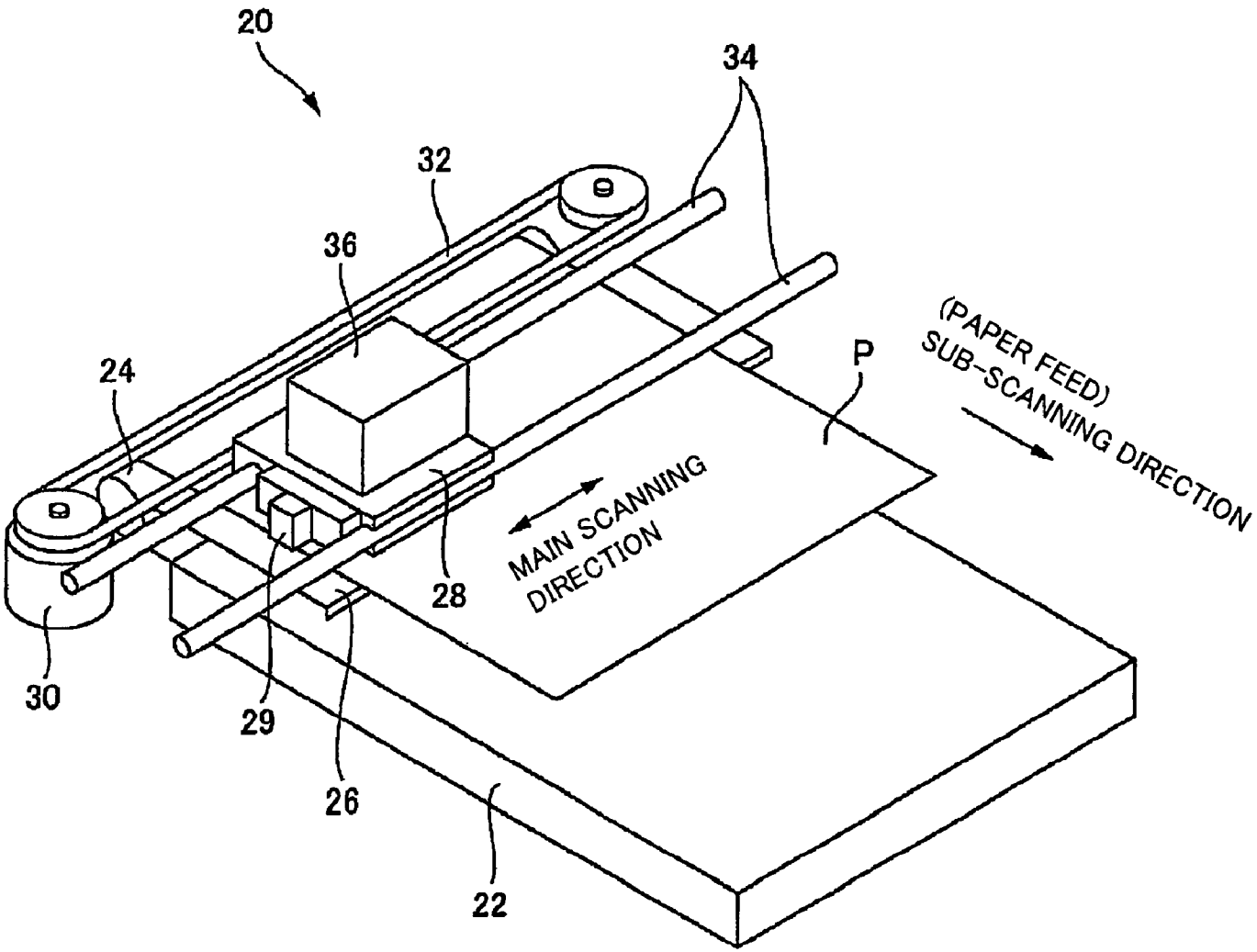
FIG. 2 is a schematic perspective view showing an example of the primary structures of a color inkjet printer 20.

FIG. 2 is a schematic perspective view showing an example of the main structures of the color inkjet printer 20. The color inkjet printer 20 is provided with a paper stacker 22, a paper feed roller 24 driven by a step motor that is not shown, a platen 26, a carriage 28 serving as an example of a movable moving member that has a print head for forming dots, a carriage motor 30, a pull belt 32 that is driven by the carriage motor 30, and guide rails 34 for the carriage 28. A print head 36 provided with numerous nozzles and a reflective optical sensor 29 that will be described in detail later are mounted onto the carriage 28.

The print paper P is rolled out from the paper stacker 22 by the paper feed roller 24 and fed in a paper feed direction (hereinafter also referred to as the sub-scanning direction), which is one example of a feeding direction of the medium to be printed, over the surface of the platen 26. The carriage 28 is pulled by the pull belt 32, which is driven by the carriage motor 30, and moves in the main-scanning direction along the guide rails 34. It should be noted that as shown in the diagram, the main scanning direction refers to the two directions perpendicular to the sub-scanning direction. The paper feed roller 24 is also used to carry out the paper-supply operation for supplying the print paper P to the color inkjet printer 20 and the paper discharge operation for discharging the print paper P from the color inkjet printer 20.

Example of Configuration of the Reflective Optical Sensor

Figure 3:
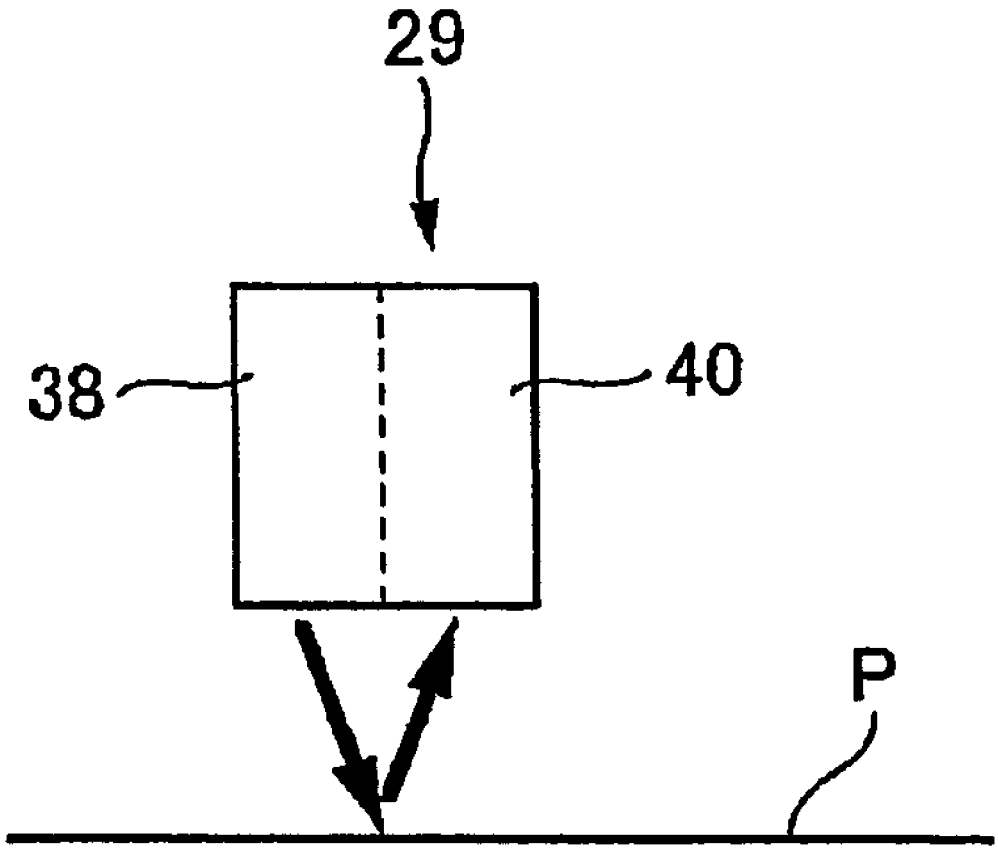
FIG. 3 is a schematic diagram for describing an example of a reflective optical sensor 29.

FIG. 3 is a schematic diagram for describing an example of the reflective optical sensor 29. The reflective optical sensor 29 is attached to the carriage 28, and has a light emitting section 38, which is for example made of a light emitting diode and is an example of light-emitting means, and a light receiving section 40, which is for example made of a phototransistor and is an example of a light-receiving sensor. The light that is emitted from the light emitting section 38, that is, the incident light, is reflected by print paper P or by the platen 26 if there is no print paper P in the direction of the emitted light. The light that is reflected is received by the light receiving section 40 and is converted into an electric signal. Then, the magnitude of the electric signal is measured as the output value of the light-receiving sensor corresponding to the intensity of the reflected light that is received.

It should be noted that in the above description, as shown in the figure, the light emitting section 38 and the light receiving section 40 are provided as a single unit and together constitute a device called the reflective optical sensor 29. However, they may also constitute separate devices, such as a light emitting device and a light receiving device.

Further, in the above description, the reflected light was converted into an electric signal and then the magnitude of that electric signal was measured in order to obtain the intensity of the reflected light that is received. However, this is not a limitation, and it is only necessary that the output value of the light-receiving sensor corresponding to the intensity of the received reflected light can be measured.

Example of Configuration of the Periphery of the Carriage

Figure 4:
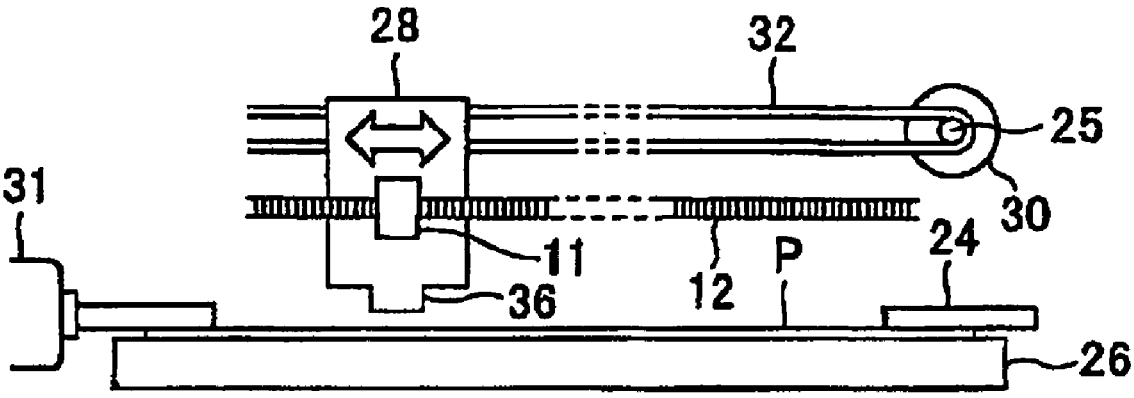
FIG. 4 is a diagram showing a configuration of the periphery of a carriage 28 of the inkjet printer.

The configuration of the periphery of the carriage is described next. FIG. 4 is a diagram showing the configuration of the periphery of the carriage 28 of the inkjet printer.

The inkjet printer shown in FIG. 4 is provided with a paper feed motor (hereinafter referred to also as a PF motor) 31 for feeding paper, the carriage 28 to which the print head 36 for ejecting ink onto the print paper P is fastened and which is driven in the main-scanning direction, the carriage motor (hereinafter referred to also as a CR motor) 30 for driving the carriage 28, a linear encoder 11 that is fastened to the carriage 28, a linear encoder code plate 12 in which slits are formed at a predetermined spacing, a rotary encoder 13, which is not shown, for the PF motor 31, the platen 26 for supporting the print paper P, the paper feed roller 24 driven by the PF motor 31 for carrying the print paper P, a pulley 25 attached to the rotational shaft of the CR motor 30, and the pull belt 32 driven by the pulley 25.

Figure 5:
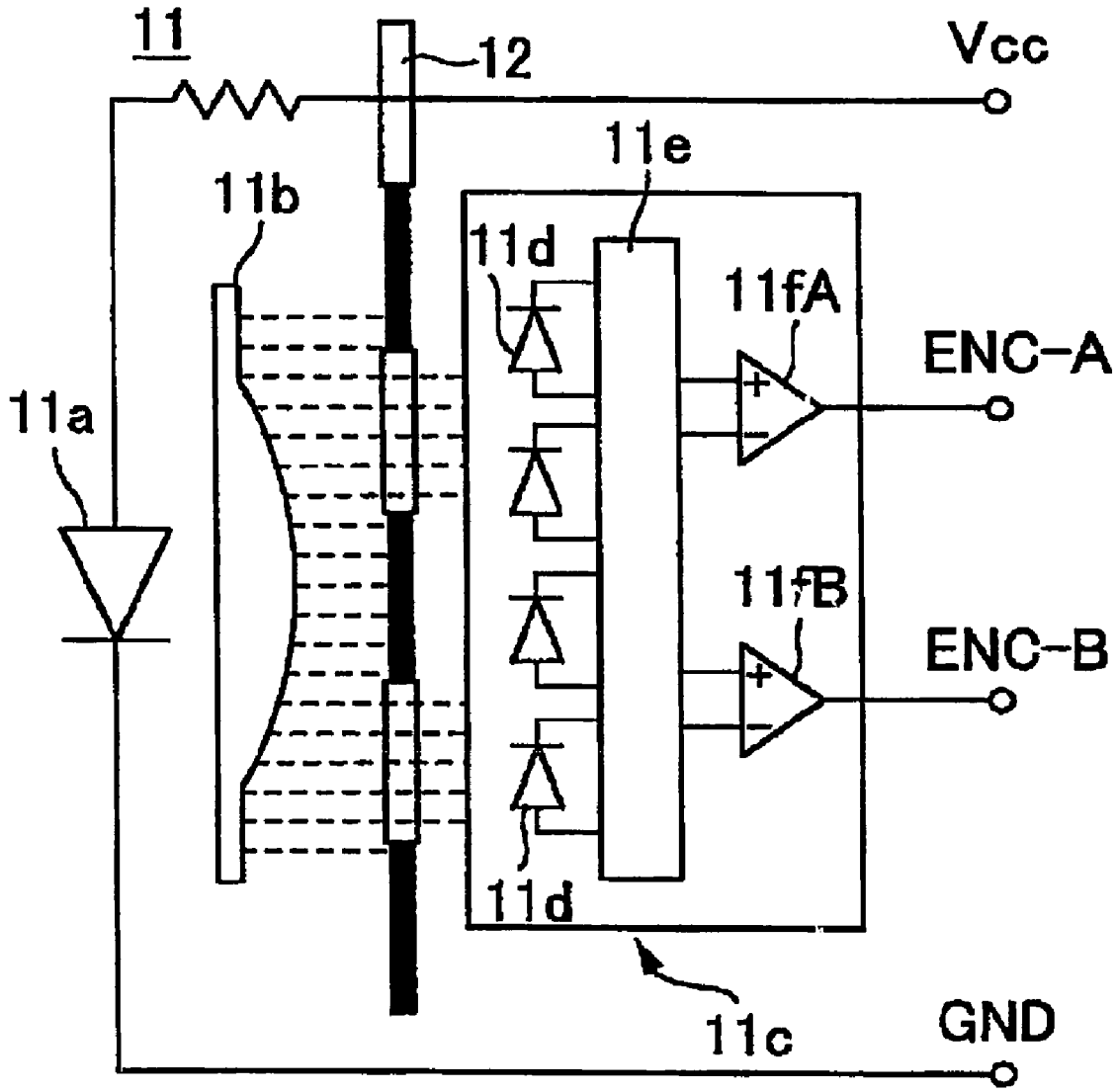
FIG. 5 is an explanatory diagram that schematically shows a configuration of a linear encoder 11 attached to the carriage 28.

Next, the above-described linear encoder 11 and the rotary encoder 13 are described. FIG. 5 is an explanatory diagram that schematically shows the configuration of the linear encoder 11 attached to the carriage 28.

The linear encoder 11 shown in FIG. 5 is provided with a light emitting diode 11*a*, a collimating lens 11*b*, and a detection processing section 11*c*. The detection processing section 11*c* has a plurality of (for example, four) photodiodes 11*d*, a signal processing circuit 11*e*, and, for example, two comparators 11*f*A and 11*f*B.

The light-emitting diode 11*a* emits light when a voltage VCC is applied to it via resistors on both sides. This light is condensed into parallel light by the collimating lens 11*b* and passes through the linear encoder code plate 12. The linear encoder code plate 12 is provided with slits at a predetermined spacing (for example, 1/180 inch (one inch=2.54 cm)).

The parallel light that has passed through the linear encoder code plate 12 then passes through stationary slits, which are not shown, and is incident on the photodiodes 11*d*, where it is converted into electric signals. The electric signals that are output from the four photodiodes 11*d* are subjected to signal processing by the signal processing circuit 11*e*, the signals that are output from the signal processing circuit 11*e* are compared in the comparators 11*f*A and 11*f*B, and the results of these comparisons are output as pulses. Then, the pulses ENC-A and ENC-B that are output from the comparators 11*f*A and 11*f*B become the output of the linear encoder 11.

Figure 6:
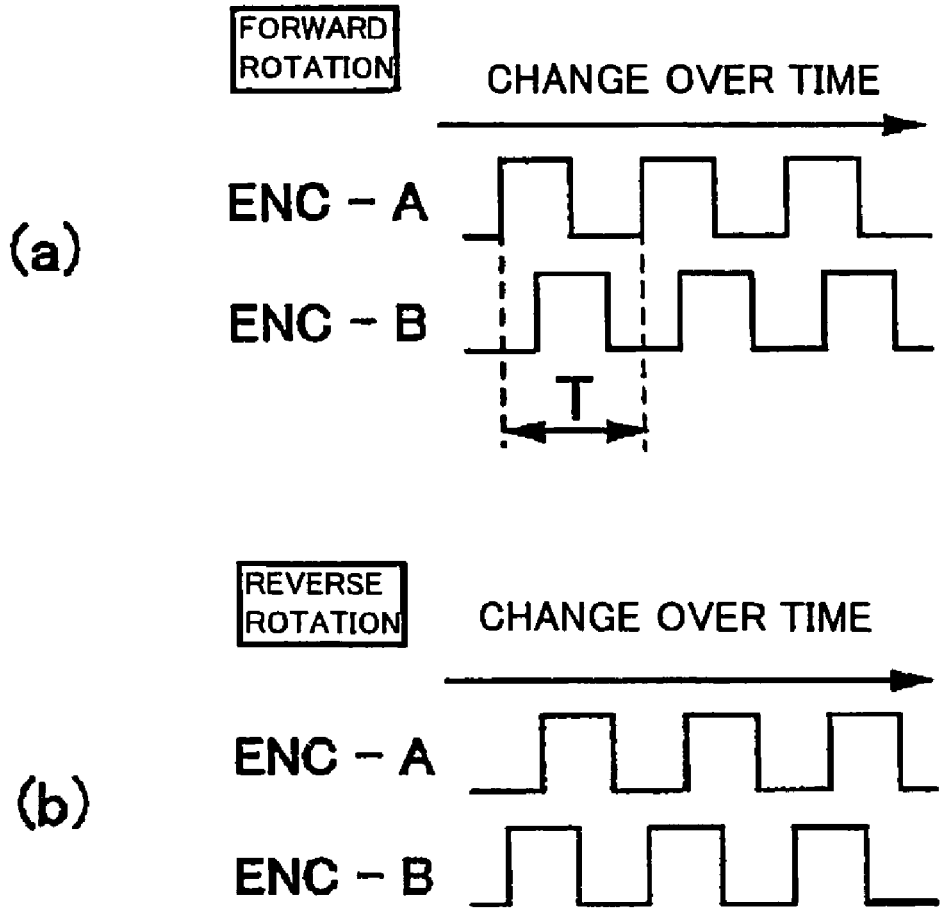
FIG. 6 shows timing charts of the waveforms of two output signals of the linear encoder 11 when the CR motor is rotating forward, and when it is rotating in reverse.

FIG. 6 is a timing chart showing waveforms of two output signals of the linear encoder 11 when the CR motor is rotating forward and when it is rotating in reverse.

As shown in FIG. 6(*a*) and FIG. 6(*b*), the phases of the pulse ENC-A and the pulse ENC-B are misaligned by 90 degrees both when the CR motor is rotating forward and when it is rotating in reverse. When the CR motor 30 is rotating forward, that is, when the carriage 28 is moving in the main-scanning direction, then, as shown in FIG. 6(*a*), the phase of the pulse ENC-A leads the phase of the pulse ENC-B by 90 degrees. On the other hand, when the CR motor 30 is rotating in reverse, then, as shown in FIG. 6(*b*), the phase of the pulse ENC-A is delayed by 90 degrees with respect to the phase of the pulse ENC-B. A single period T of the pulse ENC-A and the pulse ENC-B is equivalent to the time during which the carriage 28 is moved by the slit spacing of the linear encoder code plate 12.

Then, the rising edge and the rising edge of the output pulses ENC-A and ENC-B of the linear encoder 11 are detected, and the number of detected edges is counted. The rotational position of the CR motor 30 is obtained based on the number that is calculated. With respect to the calculation, when the CR motor 30 is rotating forward, a "+1" is added every time an edge is detected, and when the CR motor 30 is rotating in reverse, a "−1" is added every time an edge is detected. Each period of the pulses ENC-A and ENC-B is equal to the time from when one slit of the linear encoder code plate 12 passes through the linear encoder 11 to when the next slit passes through the linear encoder 11, and the phases of the pulse ENC-A and the pulse ENC-B are misaligned by 90 degrees. Accordingly, a count value "1" in the above-described calculation corresponds to ¼ of the slit spacing of the linear encoder code plate 12. Therefore, if the count value is multiplied by ¼ of the slit spacing, then the amount that the CR motor 30 has moved from the rotational position corresponding to the count value "0" can be obtained based on this product. The resolution of the linear encoder 11 at this time is ¼ the slit spacing of the linear encoder code plate 12.

On the other hand, the rotary encoder 13 for the PF motor 31 has the same configuration as the linear encoder 11, except that the rotary encoder code plate 14 is a rotation disk that rotates in conjunction with rotation of the PF motor 31. The rotary encoder 13 outputs two output pulses ENC-A and ENC-B, and based on this output the amount of movement of the PF motor 31 can be obtained.

Example of Electric Configuration of the Color Inkjet Printer

Figure 7:
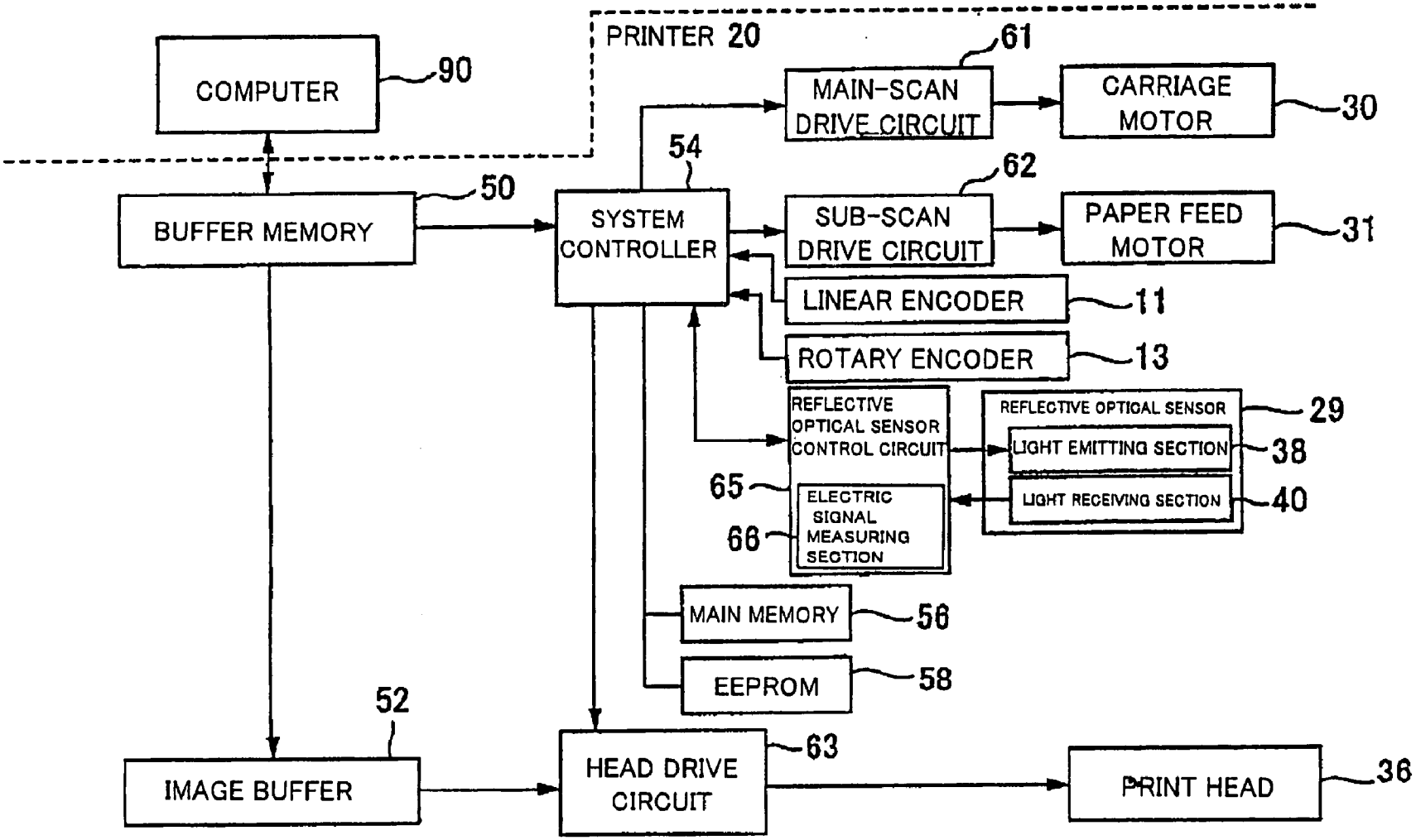
FIG. 7 is a block diagram showing an example of an electric configuration of the color inkjet printer 20.

FIG. 7 is a block diagram showing an example of the electric configuration of the color inkjet printer 20. The color inkjet printer 20 is provided with a buffer memory 50 for receiving signals supplied from the computer 90, an image buffer 52 for storing print data, a system controller 54 for controlling the overall operation of the color inkjet printer 20, a main memory 56, and an EEPROM 58. The system controller 54 is connected to a main-scan drive circuit 61 for driving the carriage motor 30, a sub-scan drive circuit 62 for driving the paper feed motor 31, a head drive circuit 63 for driving the print head 36, a reflective optical sensor control circuit 65 for controlling the light emitting section 38 and the light receiving section 40 of the reflective optical sensor 29, the above-described linear encoder 11, and the above-described rotary encoder 13. Also, the reflective optical sensor control circuit 65 is provided with an electric signal measuring section 66 for measuring the electric signals that are converted from the reflected light received by the light receiving section 40.

The print data that are transferred from the computer 90 are temporarily held in the buffer memory 50. In the color inkjet printer 20, the system controller 54 reads necessary information from the print data in the buffer memory 50, and based on this information, sends control signals to the main-scan drive circuit 61, the sub-scan drive circuit 62, and the head drive circuit 63, for example.

The image buffer 52 stores print data for a plurality of color components that are received by the buffer memory 50. The head drive circuit 63 reads the print data of each color components from the image buffer 52 in accordance with the control signals from the system controller 54, and drives the nozzle arrays for each color provided in the print head 36 in correspondence with the print data.

Example of Nozzle Arrangement of the Print Head

Figure 8:
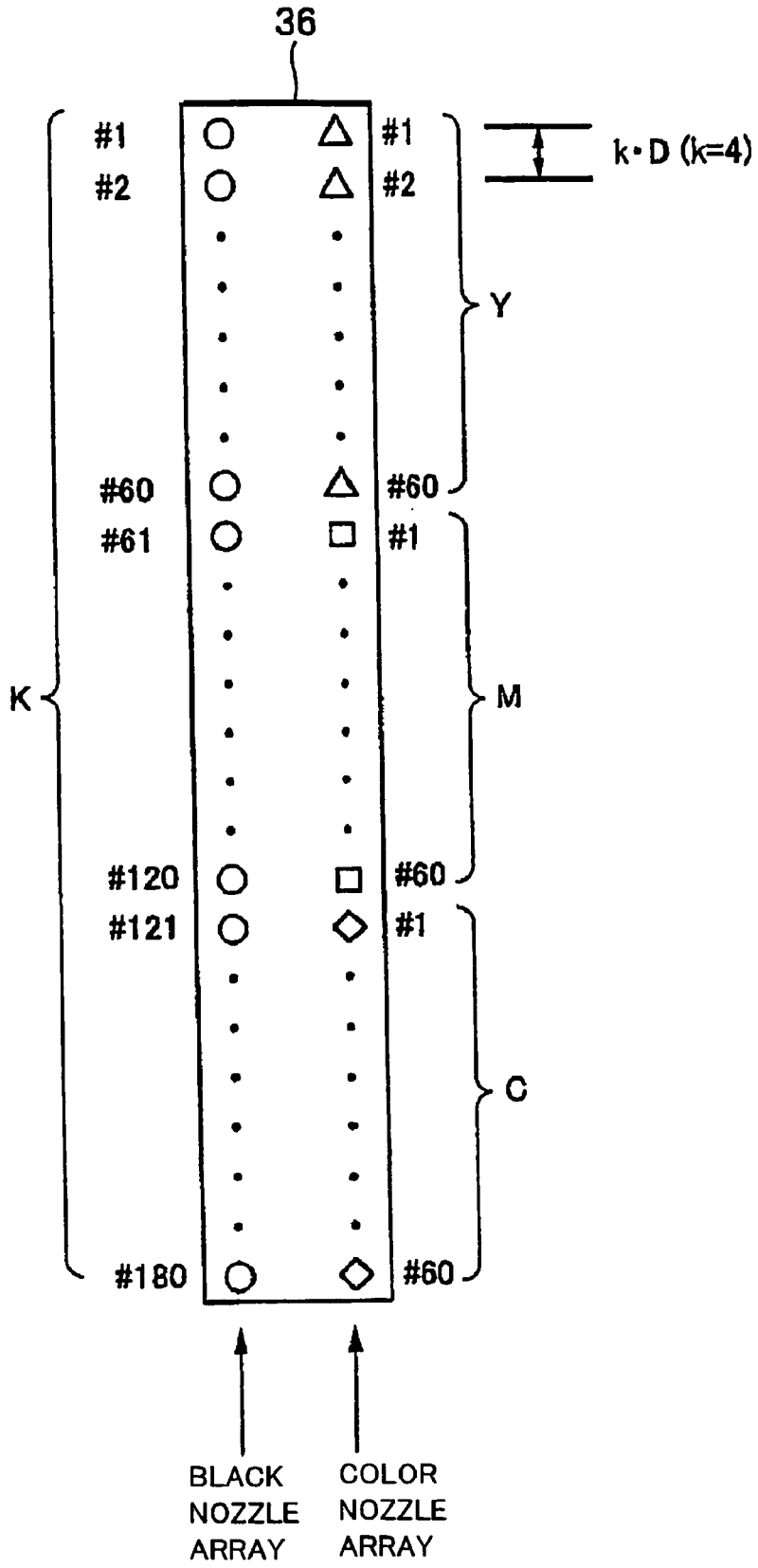
FIG. 8 is an explanatory diagram showing the nozzle arrangement on the bottom surface of a print head 36.

FIG. 8 is an explanatory diagram showing the nozzle arrangement in a lower surface of the print head 36. The print head 36 has a black nozzle array and a color nozzle array, each arranged in a straight line along the sub-scanning direction. In this specification, a "nozzle array" is referred to also as a "nozzle group".

The black nozzle array (shown by white circles) has 180 nozzles #1 to #180. These nozzles #1 to #180 are arranged at a predetermined nozzle pitch k·D along the sub-scanning direction. Here, D is the dot pitch in the sub-scanning direction, and k is an integer. The dot pitch D in the sub-scanning direction is equal to the pitch of main scanning lines (raster lines). Hereinbelow, the integer k for indicating the nozzle pitch k·D is referred to simply as the "nozzle pitch k". The unit of the nozzle pitch k is in "dots", and this refers to the dot pitch in the sub-scanning direction.

In the example of FIG. 8, the nozzle pitch k is four dots. However, the nozzle pitch k may be set to be any integer.

The color nozzle array includes a yellow nozzle group Y (shown by white triangles), a magenta nozzle group M (shown by white squares), and a cyan nozzle group C (shown by white rhombuses). Note that, in this specification, the nozzle group for chromatic color ink is also referred to as "chromatic color nozzle group". Each chromatic color nozzle group has 60 nozzles #1 to #60. Further, the nozzle pitch of the chromatic color nozzle group is the same as the nozzle pitch k of the black nozzle array. The nozzles of the chromatic color nozzle group are arranged in the same sub-scanning position as the nozzles of the black nozzle array.

At the time of printing, ink droplets are ejected from each nozzle while the print head 36 is moving with the carriage 28 at a constant speed in the main scanning direction. However, depending on the print mode, not all nozzles are always used, and there is also a case where only some nozzles are used.

First Embodiment

Figure 9:
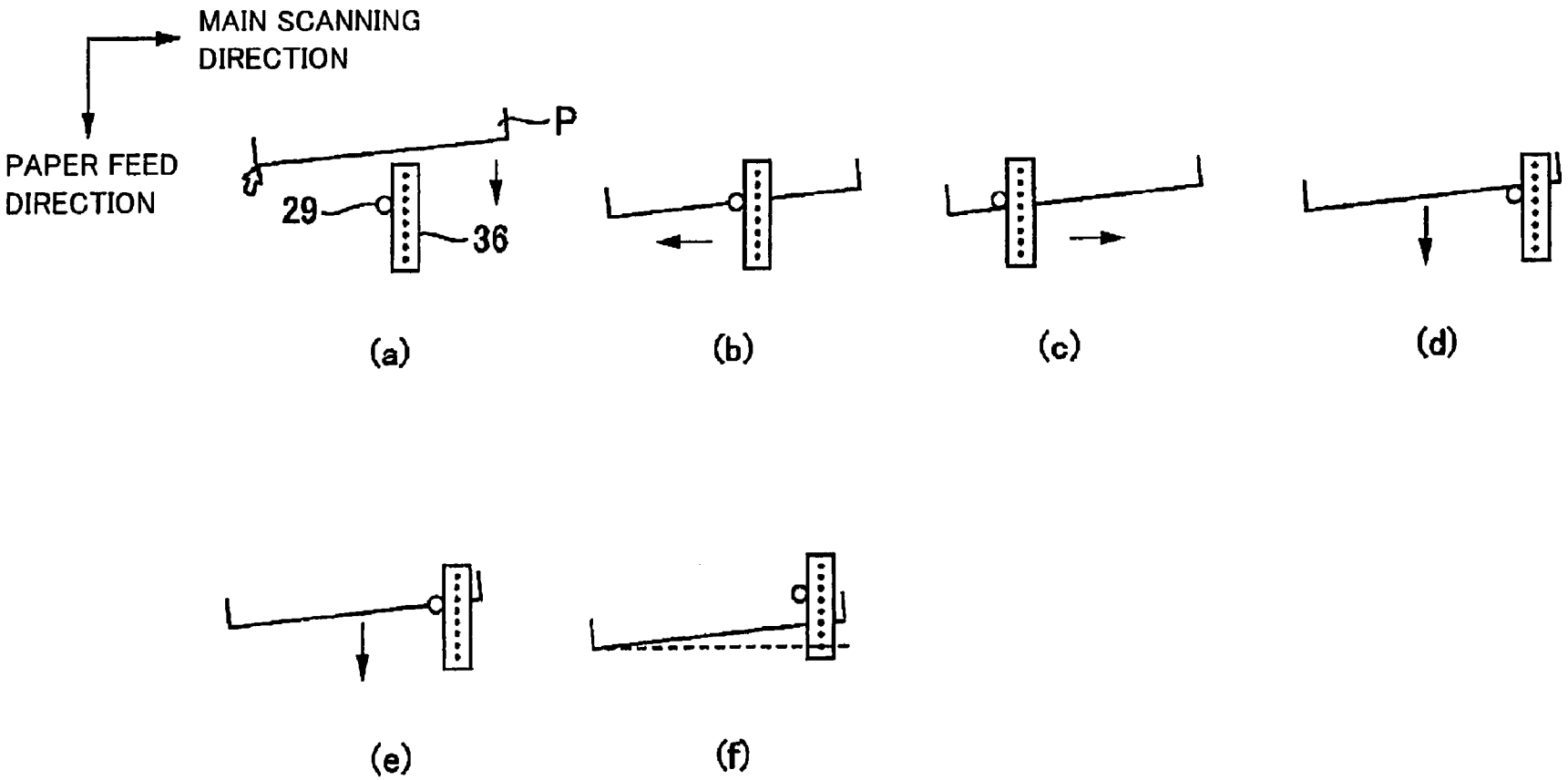
FIG. 9 is a diagram that schematically shows the positional relationship of the print head 36, the reflective optical sensor 29, and the print paper P.
Figure 10:
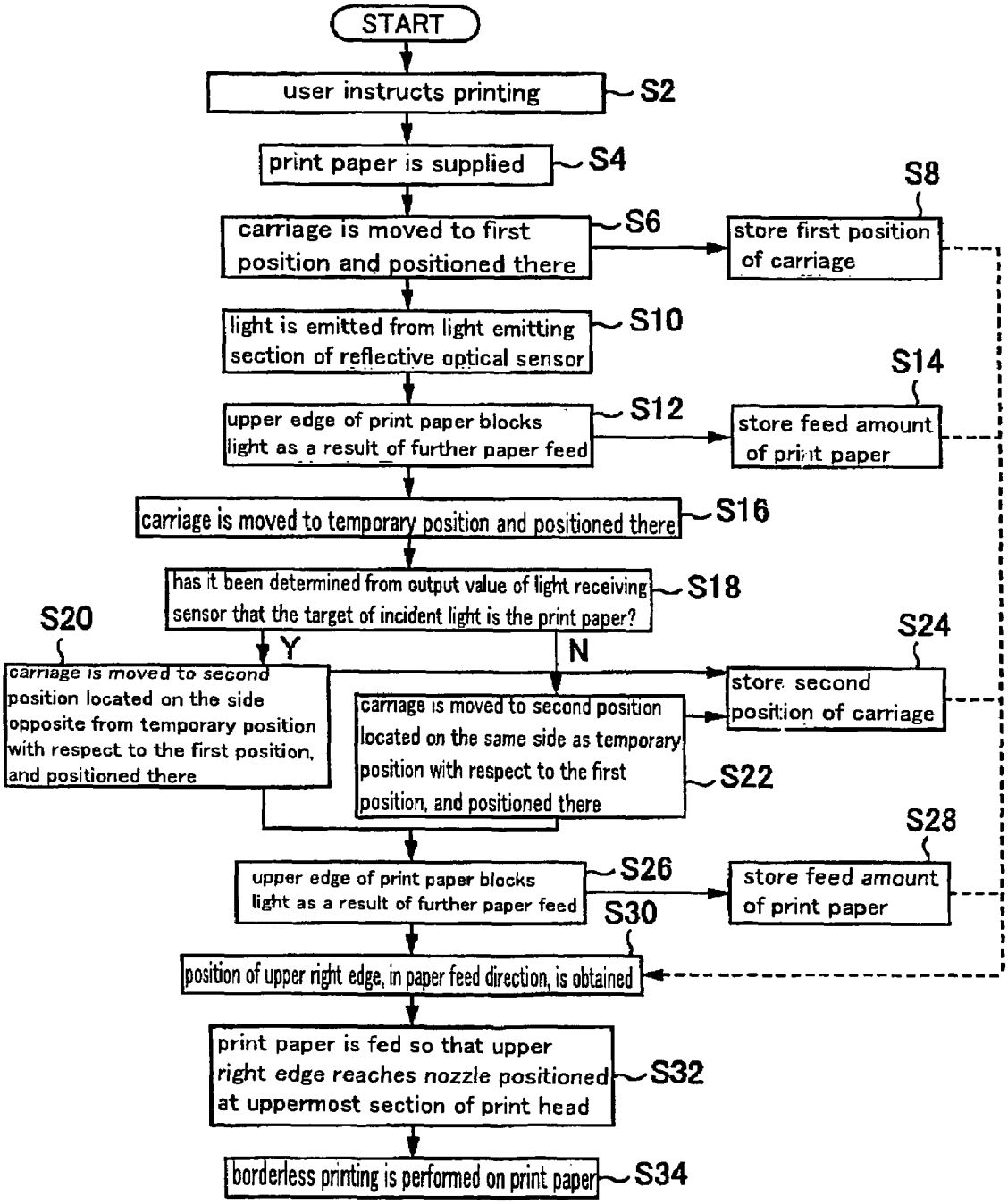
FIG. 10 is a flowchart for describing a first embodiment of a first aspect.

Next, using FIG. 9 and FIG. 10, a first embodiment of the present invention is described. FIG. 9 is a diagram schematically showing positional relationships of the print head 36, the reflective optical sensor 29, and the print paper P. FIG. 10 is a flowchart for explaining the first embodiment.

First, the user instructs printing through the application program 95 and the like (step S2). When the application program 95 which has received this instruction issues a print order, the printer driver 96 of the computer 90 receives image data from the application program 95, and converts this data into print data PD which includes raster data that indicates the state in which dots are to be formed in each main scanning and data that indicates a sub-scanning feed amount. Further, the printer driver 96 supplies the print data PD together with various commands COM to the color inkjet printer 20. After the color inkjet printer 20 receives these data with the buffer memory 50, these data are sent to the image buffer 52 or the system controller 54.

Further, the user may give instructions through the user interface display module 101 about the size of the print paper P or that borderless printing is to be performed. The instruction by the user is received by the user interface display module 101, and sent to the UI printer interface module 102. The UI printer interface module 102 interprets the instructed orders, and sends a command COM to the color inkjet printer 20. After the color inkjet printer 20 receives the command COM with the buffer memory 50, it sends the command to the system controller 54.

The color inkjet printer 20, for example, drives the paper feed motor 31 with the sub-scan drive circuit 62 based on an order sent to the system controller 54 to supply the print paper P (step S4).

Next, the system controller 54 makes the main-scan drive circuit 61 drive the CR motor 30 to move the carriage 28 to a predetermined position (hereinbelow, also referred to as a first position), and the carriage is positioned there (step S6). Then, the amount of movement of the CR motor 30 from its reference position is obtained based on the output pulses of the linear encoder 11, and the amount of movement, that is, the first position of the carriage 28 is recorded (step S8).

Further, the system controller 54 controls the reflective optical sensor 29 provided on the carriage 28, which has been placed in position, using the reflective optical sensor control circuit 65, and the light emitting section 38 of the reflective optical sensor 29 emits light towards the platen 26 (step S10).

As shown in FIG. 9(*a*) and FIG. 9(*b*), as the print paper P is further fed by the paper feed motor 31, the upper edge of the print paper P eventually blocks the light emitted from the above light emitting section 38 (step S12), as shown in FIG. 9(*b*). At this time, the target on which the light emitted by the light emitting section 38 is incident changes from the platen 26 to the print paper P, and therefore, the intensity of the electric signal which is the output value of the light receiving section 40 of the reflective optical sensor 29, which received the reflected light, changes. Then, the intensity of the electric signal is measured by the electric signal measuring section 66, and it is detected that the upper edge of the print paper P has passed the light.

Further, at this time, the system controller 54 obtains the amount of movement of the PF motor 31 from its reference position based on the output pulses of the rotary encoder 13, and stores the amount of movement, namely, the feed amount of the print paper P (step S14).

Next, the system controller 54 makes the main-scan drive circuit 61 drive the CR motor 30 to move the carriage 28 from the first position to a predetermined position (hereinbelow, also referred to as a temporary position), and the carriage is positioned there (step S16). The predetermined position may be either on the upper stream side or the lower stream side in the main scanning direction with respect to the first position. In this embodiment, as shown in FIG. 9(*b*) and FIG. 9(*c*), the carriage 28 is moved toward the upper stream side and positioned there.

Then, the system controller 54 controls the reflective optical sensor 29 with the reflective optical sensor control circuit 65, receives the reflected light of the light emitted from the light emitting section 38 with the light receiving section 40, and measures the intensity of the electric signal, which is the output value, with the electric signal measuring section 66. Further, the system controller 54 compares the measured value with a predetermined threshold, and determines whether the target on which the light is incident is the print paper P or not (step S18). That is, the intensity of the reflected light differs for the case in which the target on which the light is incident is the print paper P and for the case in which it is not (namely, when the target is the platen 26) due to, for example, difference in color of the paper and the platen. Therefore, it becomes possible to determine whether or not the target on which the light is incident is the print paper P by comparing the output value of the light receiving sensor, which corresponds to the intensity of the reflected light, with the predetermined threshold.

Next, if it is determined that the target on which the light is incident is the print paper P as a result of this determination, then the system controller 54 makes the main-scan drive circuit 61 drive the CR motor 30 to move the carriage 28 from the temporary position to a predetermined position (hereinbelow, also referred to as a second position) located on the side opposite from the temporary position with respect to the first position, and the carriage is positioned there (step S20). On the contrary, if it is determined that the target on which the light is incident is not the print paper P, then the system controller 54 moves the carriage 28 from the temporary position to a predetermined position that is located on the same side as the temporary position with respect to the first position and that is also referred to as the second position, and the carriage is positioned there (step S22). Then, based on the output pulses of the linear encoder 11, the amount of movement of the CR motor 30 from its reference position is obtained, and the amount of movement, that is, the second position of the carriage 28 is recorded (step S24).

Note that, when it is determined that the target on which the light is incident is not the print paper P, the temporary position may be regarded as the second position, without moving the carriage 28 from the temporary position to the second position.

In this embodiment, since it is determined that the target on which the light is incident is the print paper P as shown in FIG. 9(*c*), the system controller 54 moves the carriage 28 from the temporary position to the predetermined position (hereinbelow, referred to also as the second position) located on the side opposite from the temporary position with respect to the first position, and the carriage is positioned there as shown in FIG. 9(*c*) and FIG. 9(*d*) (step S20).

Further, as shown in FIG. 9(*d*) and FIG. 9(*e*), when the print paper P is further fed by the paper feed motor 31, then, as shown in FIG. 9(*e*), the upper edge of the print paper P blocks the light emitted from the light emitting section 38 (step S26). At this time, the target on which the light emitted by the light emitting section 38 is incident changes from the platen 26 to the print paper P, and therefore, the intensity of the electric signal which is the output value of the light receiving section 40 of the reflective optical sensor 29, which received the reflected light, changes. The intensity of this electric signal is measured by the electric signal measuring section 66, and it is detected that the upper edge of the print paper P has passed the light.

Further, at this time, the system controller 54 obtains the amount of movement of the PF motor 31 from its reference position based on the output pulses of the rotary encoder 13, and this amount of movement, namely, the feed amount of the print paper P is stored (step S28).

Next, based on the first position of the carriage 28 stored in step S8, the second position of the carriage 28 stored in step S24, the feed amount of the print paper P stored in step S14, and the feed amount of the print paper P stored in step S28, the system controller 54 obtains the position, in the paper feed direction, of either one of the left edge or the right edge of the upper edge that is fed leading the other in the paper feed direction.

As mentioned earlier, there are cases in which the print paper P is supplied or fed in a skewed (diagonal) manner. Strictly speaking, in such cases, either the left edge or the right edge of the upper edge is fed as the most leading edge in the paper feed direction. In the present embodiment, as shown by the hollow white arrow in FIG. 9(*a*), the right edge of the upper edge (hereinafter also referred to as the upper right edge) is fed as the most leading edge in the paper feed direction.

Figure 11:
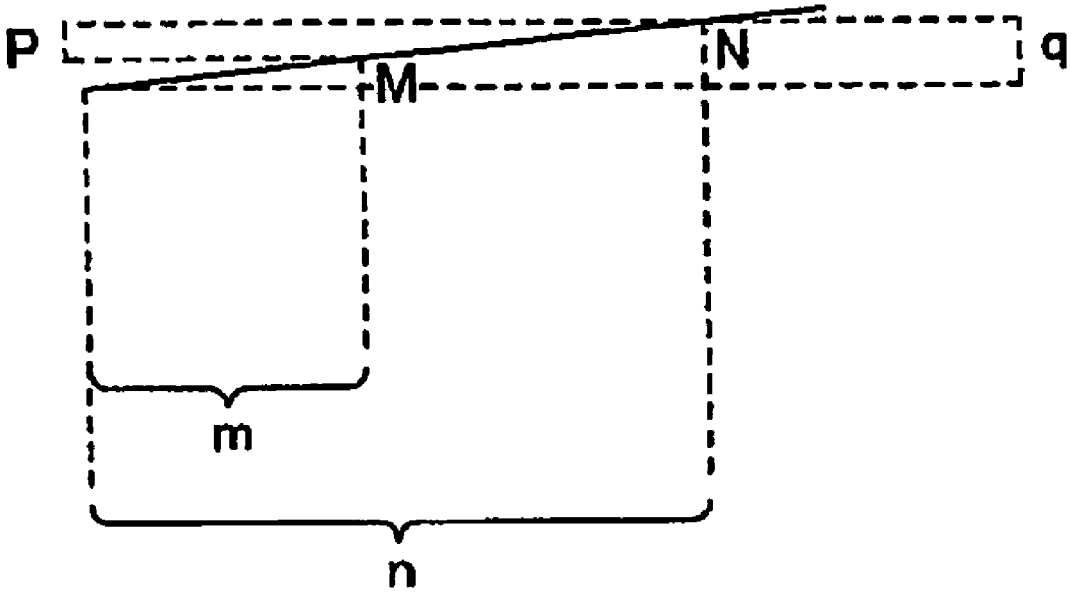
FIG. 11 is a diagram for describing an example of a method for obtaining the position, in the paper feed direction, of either one of the left edge or the right edge of the upper edge of the print paper P that is fed leading the other in the paper feed direction.

This is explained in greater detail using FIG. 11. FIG. 11 is a diagram for describing an example of a method for obtaining the position, in the paper feed direction, of either one of the left edge or the right edge of the upper edge of the print paper P that is fed leading the other in the paper feed direction.

The solid straight line shown in the figure which is inclined toward the upper right direction indicates the upper edge of the print paper P. Further, the left end of the line shown in the figure indicates the upper right edge of the print paper P, and the right end of the line indicates the left edge of the upper edge of the print paper P (hereinafter also referred to as the upper left edge). The reason why the right and left of the line and the right and left of the upper edge of the print paper P are reversed in position is because the paper feed direction is in the direction from the upper side to the lower side of the figure.

Further, as shown in the figure, the first position, which is stored in step S8, for when the first position of the carriage 28 is at point M is assumed to be numerical value m. Similarly, the second position, which is stored in step S24, for when the second position of the carriage 28 is at point N is assumed to be numerical value n. Note that, for convenience, both numerical values m and n are values that adopt the position, in the main scanning direction, of the upper right edge of the print paper P as a reference position; this, however, is not a limitation, and other positions may be adopted.

Further, as regards the paper feed direction, the difference p between the positions of point M and point N in the figure directly indicates the difference between the feed amount of the print paper P stored in step S14 and the feed amount of the print paper P stored in step S28, because the carriage moves only in the main scanning direction. Therefore, it becomes possible to obtain the difference p from the numerical values stored in step S14 and step S28.

Next, the position, in the paper feed direction, of either one of the left edge or the right edge of the upper edge that is fed leading the other in the paper feed direction (the upper right edge in this embodiment) is obtained from the numerical values m, n, and p. As shown in the figure, this position is expressed by, for example, a difference q relative to the second position (point N) in the paper feed direction. As evident from the figure, the relationship $m/n=(q-p)/q$ holds true, and by changing the form of this equation, $q=n/(n-m)\times p$ can be obtained.

In this way, the position, in the paper feed direction, of either one of the left edge or the right edge of the upper edge that is fed leading the other in the paper feed direction (the upper right edge in this embodiment), can be obtained from the numerical values stored in steps S8, S14, S24, and S28 (step S30).

Next, as shown in FIG. 9(*e*) and FIG. 9(*f*), the system controller 54 drives the paper feed motor 31 with the sub-scan drive circuit 62, and the print paper P is fed so that the upper right edge, which is the edge among the left edge or the right edge of the upper edge that is fed leading the other in the paper feed direction, reaches a predetermined position (step S32).

In the present embodiment, in order to perform borderless printing, the print paper P is fed so that the upper right edge, as shown in FIG. 9(*f*), reaches the nozzle that is positioned at the uppermost section of the print head (which is at the uppermost section in the paper feed direction but shown in FIG. 9 at the lowermost section). The feed amount in this case can be obtained by, for example, subtracting the above-mentioned numerical value q from the distance in the paper feed direction between the uppermost section of the print-head and the reflective optical sensor 29.

It should be noted that the nozzle arrangement of the print head is as already explained with reference to FIG. 8; for better understanding, however, an example in which the print head is structured by a one-array nozzle group and provided with only eight nozzles is shown in FIG. 9.

After the above-described paper feeding, the system controller 54 performs borderless printing on the print paper P by ejecting ink from the print head (step S34).

It should be noted that a program for carrying out the above-described process is stored in the EEPROM 58, and the program is executed by the system controller 54.

As described in the section of the Background Art, since there are cases in which the print paper P is supplied (or fed) in a skewed (diagonal) manner, the position of the upper edge that has been ascertained by emitting light from a light-emitting diode or the like and simply detecting a change in the output value of a light-receiving sensor such as a photodiode caused by the print paper, which is being fed, blocking the light may, strictly speaking, not be the most leading position in the paper feed direction, and therefore a problem may occur with regard to the precision with which the printing apparatus ascertains the upper edge position.

In view of the above, it becomes possible to solve the above-mentioned problem by detecting a change in the output value of the light-receiving sensor caused by the upper edge of the print paper P blocking the light at a plurality of positions, and based on the detection results, obtaining the position, in the paper feed direction, of either one of the left edge or the right edge of the upper edge that is fed leading the other in the paper feed direction, and thereby precisely ascertaining the position of the upper edge of the print paper P with a minimum of light-emitting means and a light-receiving sensor.

It should be noted that, in the description above, the position of either one of the left edge or the right edge of the upper edge that is fed leading the other in the paper feed direction was obtained based on positions, in the main scanning direction, of the first position and the second position. Broadly speaking, however, the case of obtaining the above based on the position in the main scanning direction of the first position or the position in the main scanning direction of the second position and based on the distance between these two positions is included in the case of obtaining the above based on positions in the main scanning direction of the first position and the second position.

Further, in the description above, the amounts of movement of the PF motor 31 from its reference position were obtained and these amounts of movement were stored as the feed amounts of the print paper P in step S14 and step S28, and the difference in the feed amounts was regarded as the amount of the print paper fed from when the change in the output value of the light receiving sensor was detected at the first position until when the change in the output value of the light receiving sensor was detected at the second position. The feed amount of the print paper, however, may be obtained by using the position of the PF motor 31 in step S14 as the reference position for obtaining the amount of movement of the PF motor 21 in step S28.

Further, a reflective optical sensor was used in the above description, but there is no limitation to this. For example, the light emitting section and the light receiving section may be arranged so that they oppose each other in a direction perpendicular to both the main scanning direction and the sub-scanning direction and so that the medium to be printed is inserted between the light emitting section and the light receiving section.

Further, in the above, the first position, the temporary position, and the second position were regarded as the predetermined positions; the predetermined positions, however, may be at any position. Further, when the first position and the second position are regarded as the predetermined positions, the subsequent procedures for storing the first position and the second position, that is, steps S8 and S24 may be omitted.

Also, in the above description, the print paper P was fed so that the upper right edge reaches the nozzle positioned at the uppermost section of the print head (which is at the uppermost section in the paper feed direction but shown in FIG. 9 at the lowermost section), but this is not a limitation.

Other Embodiments

A printing apparatus etc. according to the present invention was described above according to an embodiment thereof. The foregoing embodiment of the invention, however, is for the purpose of facilitating understanding of the present invention and is not to be interpreted as limiting the present invention. The invention can of course be altered and improved without departing from the gist thereof and includes equivalents thereof.

Further, print paper was described as an example of a printing medium, but a film, a cloth, a thin metal plate, and the like may be used as a printing medium.

Further, it is possible to provide a computer system that has a computer unit, a display device which is connectable to the computer unit, and a printer according to the above described embodiment which is connectable to the computer unit, and an input device such as a mouse or a keyboard, a flexible disk drive device, and a CD-ROM drive device that are provided if necessary. A computer system configured in this way will be superior to conventional computer systems as a whole.

The printer according to the above-described embodiment may have some of the functions or the mechanisms of each of the computer unit, the display device, the input device, the flexible disk drive device, and the CD-ROM drive device. For example, the printer may have a structure comprising an image processing section for performing image processing, a display section for performing various displays, and a recording media mounting section for mounting and dismounting a recording medium in which image data captured by a digital camera or the like are recorded.

The above embodiment describes a color inkjet printer, but the present invention may also be applied to monochrome inkjet printers and may also be applied to printers other than inkjet printers. The present invention is generally applicable to printing apparatuses that print on media to be printed, and may also be applied to facsimile devices and copy machines, for example.

However, as high quality printing results are particularly demanded of so-called inkjet printing apparatuses, which carry out printing by ejecting ink from a print head, the advantages of the above-described means become greater.

It should be noted that, in the above-described embodiment, the changes in the output value of the light-receiving sensor that are caused by the upper edge of the print paper P blocking the light were detected at a first position and a second position which are different from each other in the main scanning direction; and the position of either one of the left edge or the right edge of the upper edge that is fed leading the other in the paper feed direction was obtained based on a position, in the main scanning direction, of the first position, a position, in the main scanning direction, of the second position, and an amount of the medium to be printed fed from when a change in the output value is detected at the first position until when a change in the output value is detected at the second position. This, however, is not a limitation.

The above-mentioned embodiment, however, is more preferable in terms that, in this way, the number of times for detecting the changes in the output value of the light receiving sensor can be kept at a minimum, and the procedure can be simplified.

Further, in the above-mentioned embodiment, after the change in the output value was detected at the first position, the light emitting section and the light receiving section were moved either upstream or downstream in the main scanning direction from the first position; and, according to the output value of the light receiving section that has received light emitted by the light emitting section, if it is determined that the light is incident on the print paper, then the second position was set on an opposite side, with respect to the first position, from the side where the determination was made, and if it is determined that the light is not incident on the print paper, then the second position was set on a same side, with respect to the first position, as the side where the determination was made. This, however, is not a limitation, and it is also possible, for example, to omit these procedures upon setting the second position.

If, however, the second position is set, without carrying out the above-mentioned procedures, on the side where the target of incidence would be on the print paper if the light were emitted, then it would be necessary to feed the print paper backwards in order for the upper edge of the print paper to block the light at the second position. The present embodiment is therefore more preferable in terms that it is possible to avoid such an inconvenience.

Furthermore, in the above-described embodiment, the light emitting section and the light receiving section were provided on a movable carriage that is provided with a print head for forming dots, but this is not a limitation. For example, the carriage and the light emitting section and light receiving section may be so configured that they are separately movable in the main scanning direction.

However, the above-described embodiment is preferable in terms that, in this way, it is possible to share the moving mechanisms of the carriage, the light emitting section, and the light receiving section.

Furthermore, in the above-described embodiment, printing was carried out on the print paper after the print paper was fed so that either one of the left edge or the right edge of the upper edge that is fed leading the other in the paper feed direction reaches a predetermined position, but this is not a limitation.

However, the above-described embodiment is preferable in terms that, in this way, printing can be carried out precisely in the position where dots should be formed on the print paper.

Furthermore, borderless printing was carried out in the above-described embodiment, but this is not a limitation.

However, since it is necessary to accurately ascertain the position of the upper edge of the print paper in the case of borderless printing because printing is carried out also on the upper edge of the print paper, and therefore, the advantages obtained by the above-described procedure are greater.

Second Embodiment

At least the following matters will be made clear by the explanation in the present specification and the description of the accompanying drawings.

A printing apparatus comprises: feeding means for feeding, in a predetermined feeding direction, a medium to be printed that has been supplied; light-emitting means for emitting light; and a light-receiving sensor for receiving light emitted by the light-emitting means, the printing apparatus being capable of detecting a change in an output value of the light-receiving sensor that is caused by the medium to be printed, which has been fed by the feeding means, blocking the light, which has been emitted by the light-emitting means, wherein the printing apparatus detects, at a plurality of positions, changes in the output value that are caused by a lower edge of the medium to be printed blocking the light, and based on a result of the detection, obtains a position, in the feeding direction, of either one of a left edge or a right edge of the lower edge that is fed trailing the other in the feeding direction.

By detecting, at a plurality of positions, the changes in the output value that are caused by the lower edge of the medium to be printed blocking the light, and obtaining the position, in the feeding direction, of either one of the left edge or the right edge of the lower edge that is fed trailing the other in the feeding direction based on a result of the detection, it is possible to precisely ascertain the position of the lower edge of the medium to be printed.

It is also possible to eject ink from a print head to form dots on the medium to be printed.

As high quality printing results are particularly demanded of so-called inkjet printing apparatuses, which carry out printing by ejecting ink from a print head, the advantages of the above-described procedure become greater.

It is also possible to detect, at a plurality of positions, the changes in the output value that are caused by the lower edge of the medium to be printed blocking the light, by moving the light-emitting means and the light-receiving sensor in the main scanning direction.

In this way, it is possible to reduce the number of light-emitting means and light-receiving sensors to be prepared.

It is also possible to detect, at a first position and a second position which are different from each other in the main scanning direction, the changes in the output value that are caused by the lower edge of the medium to be printed blocking the light; and to obtain the position of either one of the left edge or the right edge of the lower edge that is fed trailing the other in the feeding direction based on a position, in the main scanning direction, of the first position, a position, in the main scanning direction, of the second position, and an amount of the medium to be printed fed from when a change in the output value is detected at the first position until when a change in the output value is detected at the second position.

Doing this allows the number of times for detecting the changes in the output value of the light-receiving sensor to be minimized, and the procedure can be simplified.

It is also possible to determine which of either the left edge or the right edge of the lower edge is fed trailing in the feeding direction before moving the light-emitting means and the light-receiving sensor from the first position; and to determine whether to set the second position downstream or upstream in the main scanning direction with respect to the first position, based on a result of the determination.

In this way, it is possible to avoid the inefficiency of adopting a temporary position when moving from the first position to the second position.

It is also possible to detect, by making the medium to be printed stationary and moving the light-emitting means in the main scanning direction, a change in the output value of the light-receiving sensor that is caused by the light, which is emitted by the light-emitting means, passing across an edge of the medium to be printed to specify the position of the edge; and to determine which of either the left edge or the right edge of the lower edge is fed trailing in the feeding direction, based on the position of the edge that has been specified.

Since the operation of making the medium to be printed stationary and moving the light-emitting means in the main scanning direction is in common with the operation of carrying out printing on the medium to be printed, the information for making the determination can be obtained efficiently.

It is also possible to feed the medium to be printed with the feeding means after specifying the position of the edge; to again detect, by making the medium to be printed stationary and moving the light-emitting means in the main scanning direction, a change in the output value of the light-receiving sensor that is caused by the light, which is emitted by the light-emitting means, passing across an edge of the medium to be printed to specify the position of that edge; and to determine which of either the left edge or the right edge of the lower edge is fed trailing in the feeding direction, based on the positions of the two edges that have been specified.

In this way, the amount of information for making the determination increases, and therefore, it is possible to precisely determine which of either the left edge or the right edge of the lower edge is fed trailing in the feeding direction.

It is also possible that the light-emitting means and the light-receiving sensor are provided on a movable moving member that is provided with a print head for forming dots.

Doing this allows the moving mechanisms of the moving member, the light emitting section, and the light receiving section to be shared.

It is also possible to carry out printing with respect to an entire surface of the medium to be printed.

In the case of carrying out printing with respect to an entire surface of the medium to be printed, it is necessary to accurately ascertain the position of the lower edge of the medium to be printed since printing is carried out also on the lower edge of the medium to be printed; therefore, the advantages of the above-described procedure become greater.

Further, a printing apparatus comprises: feeding means for feeding, in a predetermined feeding direction, a medium to be printed that has been supplied; light-emitting means for emitting light; and a light-receiving sensor for receiving light emitted by the light-emitting means, the printing apparatus being capable of carrying out printing with respect to an entire surface of the medium to be printed by ejecting ink from a print head, and detecting a change in an output value of the light-receiving sensor that is caused by the medium to be printed, which has been fed by the feeding means, blocking the light, which has been emitted by the light-emitting means, wherein: the light-emitting means and the light-receiving sensor are provided on a movable moving member that is provided with the print head for ejecting ink to form dots; by moving the light-emitting means and the light-receiving sensor in a main scanning direction, the printing apparatus detects, at a first position and a second position which are different from each other in the main scanning direction, changes in the output value that are caused by a lower edge of the medium to be printed blocking the light; the printing apparatus obtains the position of either one of the left edge or the right edge of the lower edge that is fed trailing the other in the feeding direction based on a position, in the main scanning direction, of the first position, a position, in the main scanning direction, of the second position, and an amount of the medium to be printed fed from when a change in the output value is detected at the first position until when a change in the output value is detected at the second position; before moving the light-emitting means and the light-receiving sensor from the first position: by making the medium to be printed stationary and moving the light-emitting means in the main scanning direction, the printing apparatus detects a change in the output value of the light-receiving sensor that is caused by the light, which is emitted by the light-emitting means, passing across an edge of the medium to be printed to specify the position of the edge; the printing apparatus feeds the medium to be printed with the feeding means after specifying the position of the edge; by making the medium to be printed stationary and moving the light-emitting means in the main scanning direction, the printing apparatus again detects a change in the output value of the light-receiving sensor that is caused by the light, which is emitted by the light-emitting means, passing across an edge of the medium to be printed to specify the position of that edge; and based on the positions of the two edges that have been specified, the printing apparatus determines which of either the left edge or the right edge of the lower edge is fed trailing in the feeding direction; and based on a result of the determination, the printing apparatus determines whether to set the second position downstream or upstream in the main scanning direction with respect to the first position.

Doing this allows all of the above-described effects to be achieved, and therefore, the objects of the present invention are most effectively achieved.

Furthermore, in a method for determining a lower edge of a medium to be printed with a printing apparatus that is provided with: feeding means for feeding, in a predetermined feeding direction, a medium to be printed that has been supplied; light-emitting means for emitting light; and a light-receiving sensor for receiving light emitted by the light-emitting means, the printing apparatus being capable of detecting a change in an output value of the light-receiving sensor that is caused by the medium to be printed, which has been fed by the feeding means, blocking the light, which has been emitted by the light-emitting means, the method for determining the lower edge of the medium to be printed comprises: a step of detecting, at a plurality of positions, changes in the output value that are caused by the lower edge of the medium to be printed blocking the light; and a step of obtaining a position, in the feeding direction, of either one of a left edge or a right edge of the lower edge that is fed trailing the other in the feeding direction, based on a result of the detection.

By detecting, at a plurality of positions, the changes in the output value that are caused by the lower edge of the medium to be printed blocking the light, and obtaining the position, in the feeding direction, of either one of the left edge or the right edge of the lower edge that is fed trailing the other in the feeding direction based on a result of the detection, it is possible to precisely ascertain the position of the lower edge of the medium to be printed.

Furthermore, it is also possible to achieve a computer program for causing a printing apparatus to execute the above-described method that exhibits the above-described effects of being able to precisely ascertain the position of the lower edge of the medium to be printed.

Furthermore, a computer system comprises: a computer unit; and a printing apparatus that is connectable to the computer unit, the printing apparatus being provided with: feeding means for feeding, in a predetermined feeding direction, a medium to be printed that has been supplied; light-emitting means for emitting light; and alight-receiving sensor for receiving light emitted by the light-emitting means, and the printing apparatus being capable of detecting a change in an output value of the light-receiving sensor that is caused by the medium to be printed, which has been fed by the feeding means, blocking the light, which has been emitted by the light-emitting means, wherein the printing apparatus detects, at a plurality of positions, changes in the output value that are caused by a lower edge of the medium to be printed blocking the light, and based on a result of the detection, the printing apparatus obtains a position, in the feeding direction, of either one of a left edge or a right edge of the lower edge that is fed trailing the other in the feeding direction.

A computer system achieved in this way becomes superior to conventional systems as an overall system.

Example of Overall Configuration of the Apparatus

Figure 12:
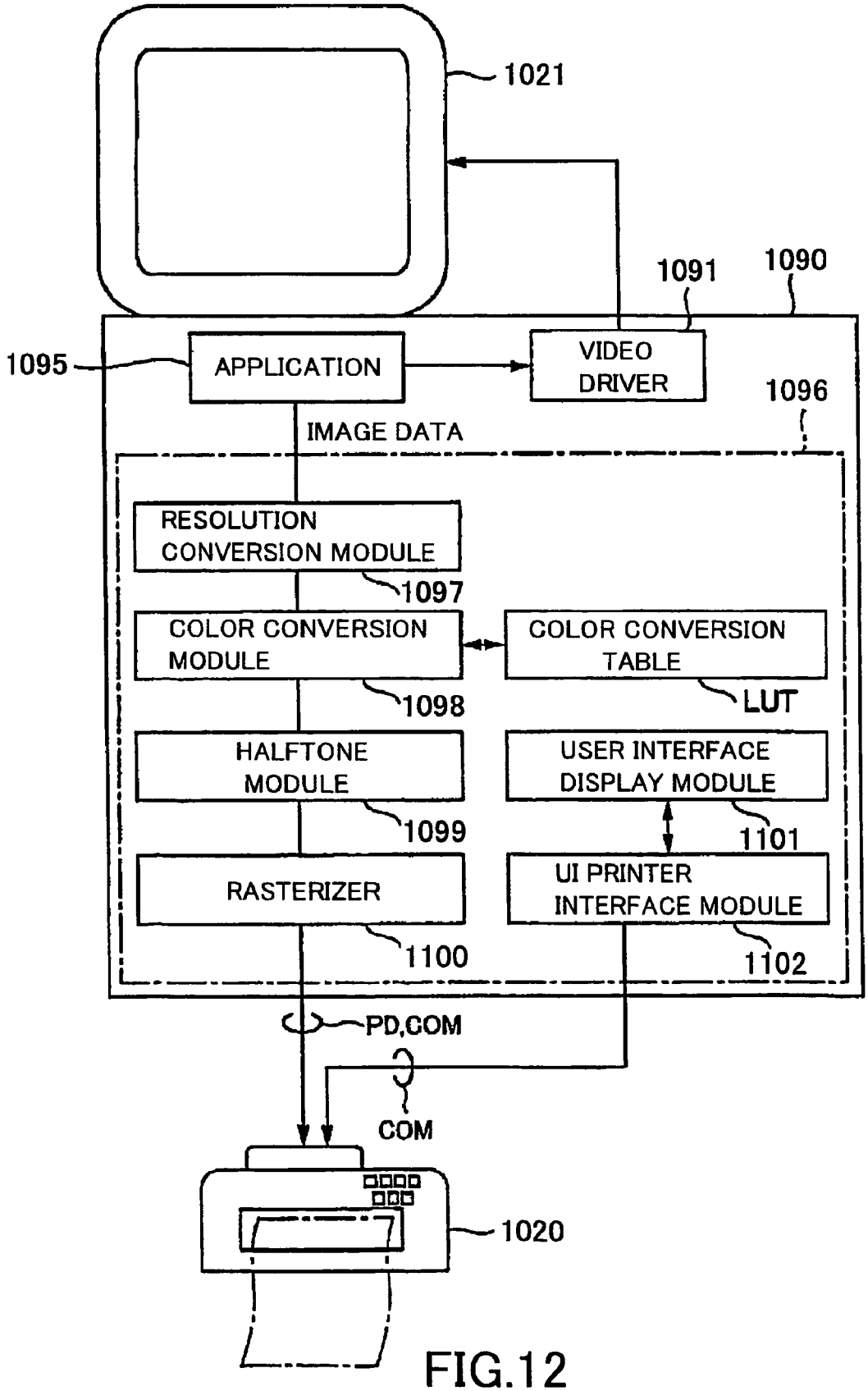
FIG. 12 is a block diagram showing a configuration of a printing system as one example of the present invention.

FIG. 12 is a block diagram showing the configuration of a printing system serving as an example of the present invention. The printing system is provided with a computer 1090 and a color inkjet printer 1020, which is an example of a printing apparatus. It should be noted that the printing system including the color inkjet printer 1020 and the computer 1090 can also be broadly referred to as a "printing apparatus." Although not shown in the figure, a computer system is made of the computer 1090, the color inkjet printer 1020, a display device such as a CRT 1021 or a liquid crystal display device, input devices such as a keyboard and a mouse, and a drive device such as a flexible drive device or a CD-ROM drive device.

In the computer 1090, an application program 1095 is executed under a predetermined operating system. The operating system includes a video driver 1091 and a printer driver 1096, and the application program 1095 outputs print data PD to be transferred to the color inkjet printer 1020 through these drivers. The application program 1095, which carries out retouching of images, for example, carries out a desired process with respect to an image to be processed, and also displays the image on the CRT 1021 via the video driver 1091.

When the application program 1095 issues a print command, the printer driver 1096 of the computer 1090 receives image data from the application program 1095 and converts these into print data PD to be supplied to the color inkjet printer 1020. The printer driver 1096 is internally provided with a resolution conversion module 1097, a color conversion module 1098, a half tone module 1099, a rasterizer 1100, a user interface display module 1101, a UI printer interface module 1102, and a color conversion look-up table LUT.

The resolution conversion module 1097 performs the function of converting the resolution of the color image data formed by the application program 1095 to a print resolution. The image data whose resolution is thus converted is image information still made of the three color components RGB. The color conversion module 1098 refers to the color conversion look-up table LUT and, for each pixel, converts the RGB image data into multi-gradation data of a plurality of ink colors that can be used by the color inkjet printer 1020.

The multi-gradation data that have been color converted have a gradation value of 256 levels, for example. The halftone module 1099 executes so-called halftone processing to generate halftone image data. The halftone image data are rearranged by the rasterizer 1100 into the order in which they are to be transferred to the color inkjet printer 1020, and are output as the final print data PD. The print data PD include raster data indicating the state in which dots are formed during each main scan movement, and data indicating the sub-scanning feed amount.

The user interface display module 1101 has a function for displaying various types of user interface windows related to printing and a function for receiving input from the user in these windows.

The UI printer interface module 1102 has a function as an interface between the user interface (UI) and the color inkjet printer. It interprets instructions given by users through the user interface and sends various commands COM to the color inkjet printer, and conversely, it also interprets commands COM received from the color inkjet printer and executes various displays with respect to the user interface.

It should be noted that the printer driver 1096 achieves, for example, a function for sending and receiving various types of commands COM and a function for supplying print data PD to the color inkjet printer 1020. A program for realizing the functions of the printer driver 1096 is supplied in a format in which it is stored on a computer-readable storage medium. Various kinds of computer-readable media, such as flexible disks, CD-ROMs, magneto optical disks, IC cards, ROM cartridges, punch cards, printed materials on which a code is printed such as a bar code, and internal storage devices (memory such as a RAM or a ROM) and external storage devices of the computer can be used. The computer program can also be downloaded onto the computer 1090 via the Internet.

Figure 13:
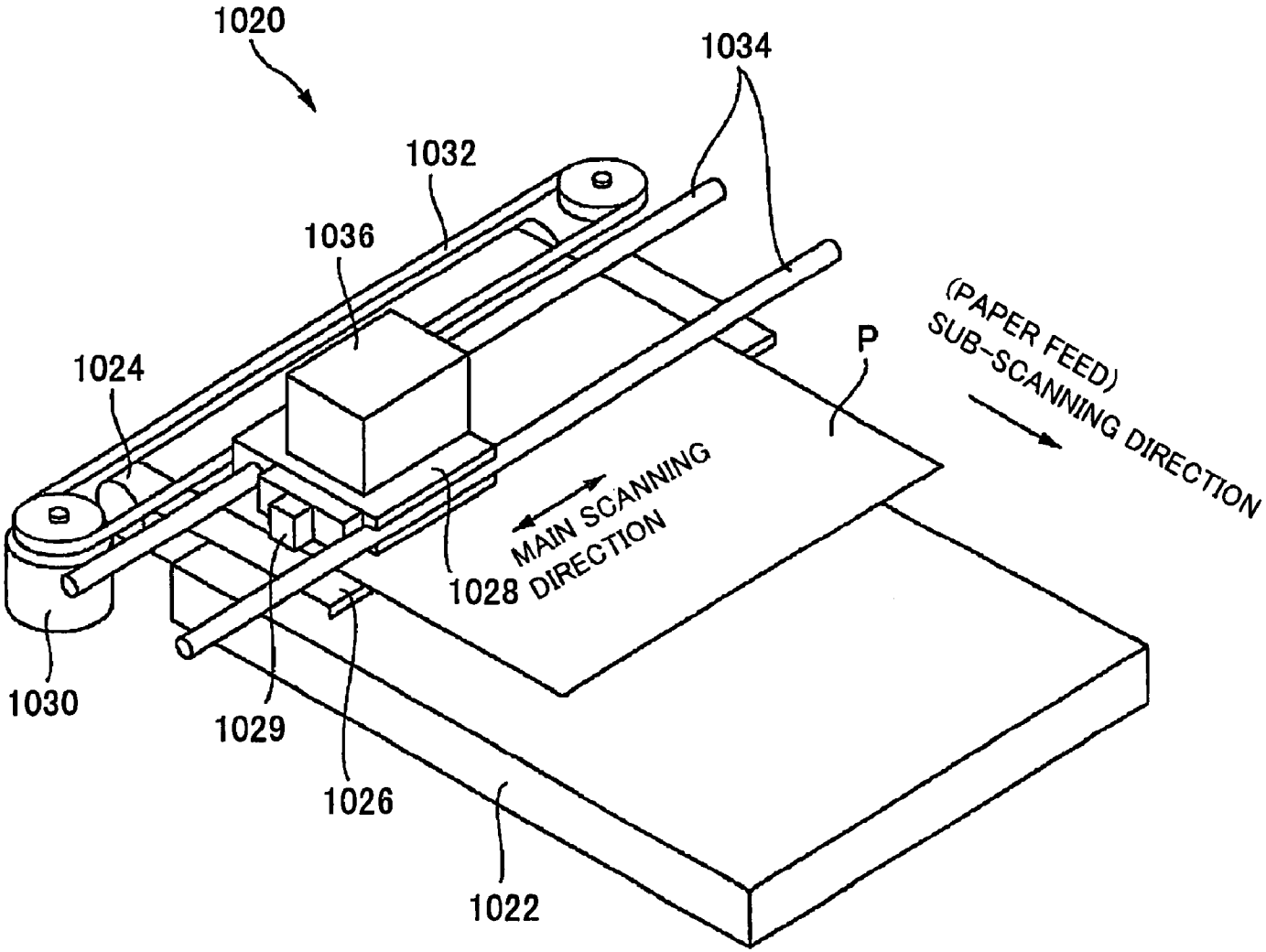
FIG. 13 is a schematic perspective view showing an example of the primary structures of a color inkjet printer 1020.

FIG. 13 is a schematic perspective view showing an example of the main structures of the color inkjet printer 1020. The color inkjet printer 1020 is provided with a paper stacker 1022, a paper feed roller 1024 driven by a step motor that is not shown, a platen 1026, a carriage 1028 serving as an example of a movable moving member that has a print head for forming dots, a carriage motor 1030, a pull belt 1032 that is driven by the carriage motor 1030, and guide rails 1034 for the carriage 1028. A print head 1036 provided with numerous nozzles and a reflective optical sensor 1029 that will be described in detail later are mounted onto the carriage 1028.

The print paper P is rolled out from the paper stacker 1022 by the paper feed roller 1024 and fed in a paper feed direction (hereinafter also referred to as the sub-scanning direction), which is one example of a feeding direction of the medium to be printed, over the surface of the platen 1026. The carriage 1028 is pulled by the pull belt 1032, which is driven by the carriage motor 1030, and moves in the main-scanning direction along the guide rails 1034. It should be noted that as shown in the diagram, the main scanning direction refers to the two directions perpendicular to the sub-scanning direction. The paper feed roller 1024 is also used to carry out the paper-supply operation for supplying the print paper P to the color inkjet printer 1020 and the paper discharge operation for discharging the print paper P from the color inkjet printer 1020.

Example of Configuration of the Reflective Optical Sensor

Figure 14:
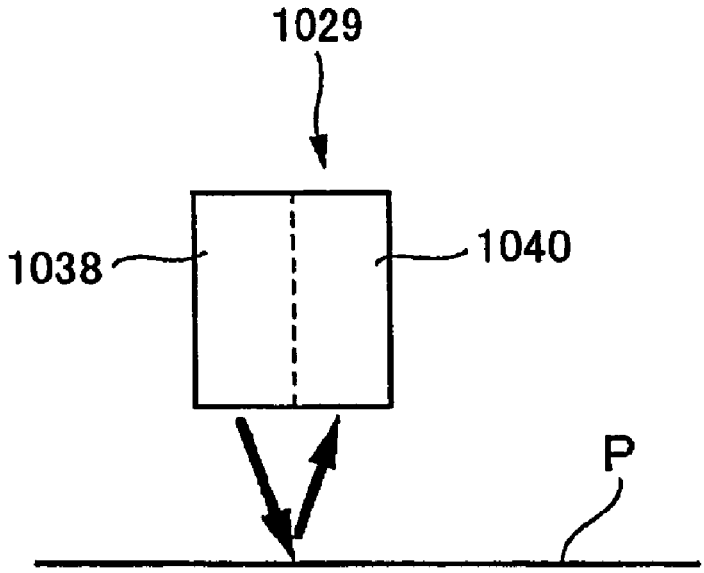
FIG. 14 is a schematic diagram for describing an example of a reflective optical sensor 1029.

FIG. 14 is a schematic diagram for describing an example of the reflective optical sensor 1029. The reflective optical sensor 1029 is attached to the carriage 1028, and has a light emitting section 1038, which is for example made of a light emitting diode and is an example of light-emitting means, and a light receiving section 1040, which is for example made of a phototransistor and is an example of a light-receiving sensor. The light that is emitted from the light emitting section 1038, that is, the incident light, is reflected by print paper P or by the platen 1026 if there is no print paper P in the direction of the emitted light. The light that is reflected is received by the light receiving section 1040 and is converted into an electric signal. Then, the magnitude of the electric signal is measured as the output value of the light-receiving sensor corresponding to the intensity of the reflected light that is received.

It should be noted that in the above description, as shown in the figure, the light emitting section 1038 and the light receiving section 1040 are provided as a single unit and together constitute a device called the reflective optical sensor 1029. However, they may also constitute separate devices, such as a light emitting device and a light receiving device.

Further, in the above description, the reflected light was converted into an electric signal and then the magnitude of that electric signal was measured in order to obtain the intensity of the reflected light that is received. However, this is not a limitation, and it is only necessary that the output value of the light-receiving sensor corresponding to the intensity of the received reflected light can be measured.

Example of Configuration of the Periphery of the Carriage

Figure 15:
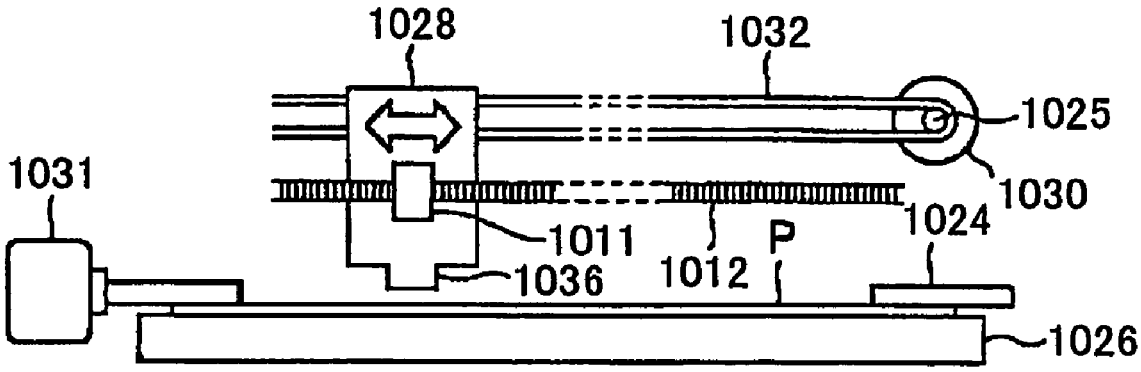
FIG. 15 is a diagram showing a configuration of the periphery of a carriage 1028 of the inkjet printer.

The configuration of the periphery of the carriage is described next. FIG. 15 is a diagram showing the configuration of the periphery of the carriage 1028 of the inkjet printer.

The inkjet printer shown in FIG. 15 is provided with a paper feed motor (hereinafter referred to also as a PF motor) 1031 that is for feeding paper and that serves as an example of printing medium feeding means, the carriage 1028 to which the print head 1036 for ejecting ink onto the print paper P is fastened and which is driven in the main-scanning direction, the carriage motor (hereinafter referred to also as a CR motor) 1030 for driving the carriage 1028, a linear encoder 1011 that is fastened to the carriage 1028, a linear encoder code plate 1012 in which slits are formed at a predetermined spacing, a rotary encoder 1013, which is not shown, for the PF motor 1031, the platen 1026 for supporting the print paper P, the paper feed roller 1024 driven by the PF motor 1031 for carrying the print paper P, a pulley 1025 attached to the rotational shaft of the CR motor 1030, and the pull belt 1032 driven by the pulley 1025.

Figure 16:
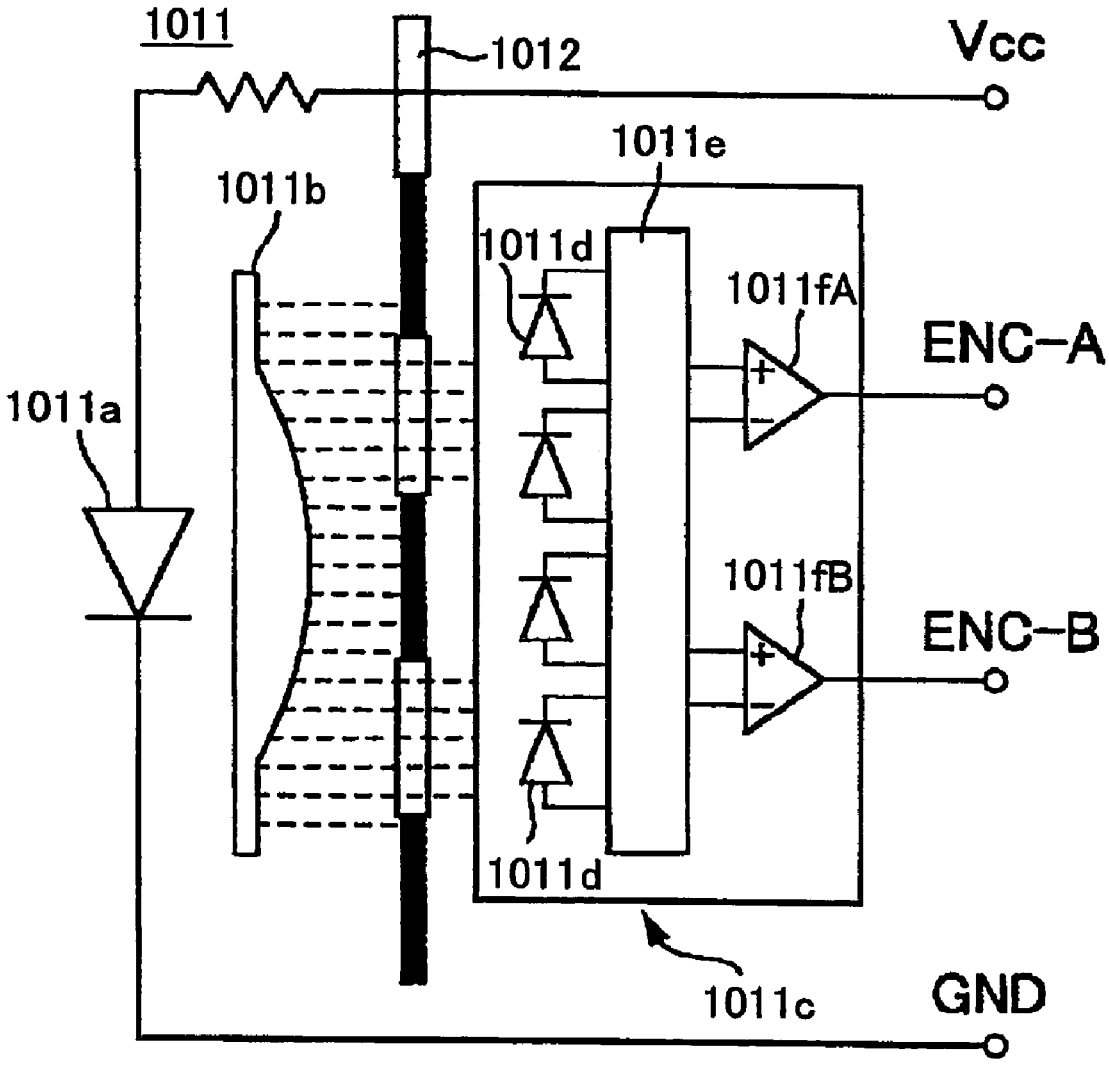
FIG. 16 is an explanatory diagram that schematically shows a configuration of a linear encoder 1011 attached to the carriage 1028.

Next, the above-described linear encoder 1011 and the rotary encoder 1013 are described. FIG. 16 is an explanatory diagram that schematically shows the configuration of the linear encoder 1011 attached to the carriage 1028.

The linear encoder 1011 shown in FIG. 16 is provided with a light emitting diode 1011*a*, a collimating lens 1011*b*, and a detection processing section 1011*c*. The detection processing section 1011*c* has a plurality of (for example, four) photodiodes 1011*d*, a signal processing circuit 1011*e*, and, for example, two comparators 1011*f*A and 1011*f*B.

The light-emitting diode 1011*a* emits light when a voltage VCC is applied to it via resistors on both sides. This light is condensed into parallel light by the collimating lens 1011*b* and passes through the linear encoder code plate 1012. The linear encoder code plate 1012 is provided with slits at a predetermined spacing (for example, 1/180 inch (one inch=2.54 cm)).

The parallel light that has passed through the linear encoder code plate 1012 then passes through stationary slits, which are not shown, and is incident on the photodiodes 1011*d*, where it is converted into electric signals. The electric signals that are output from the four photodiodes 1011*d* are subjected to signal processing by the signal processing circuit 1011*e*, the signals that are output from the signal processing circuit 1011*e* are compared in the comparators 1011*f*A and 1011*f*B, and the results of these comparisons are output as pulses. Then, the pulses ENC-A and ENC-B that are output from the comparators 1011*f*A and 1011*f*B become the output of the linear encoder 1011.

Figure 17:
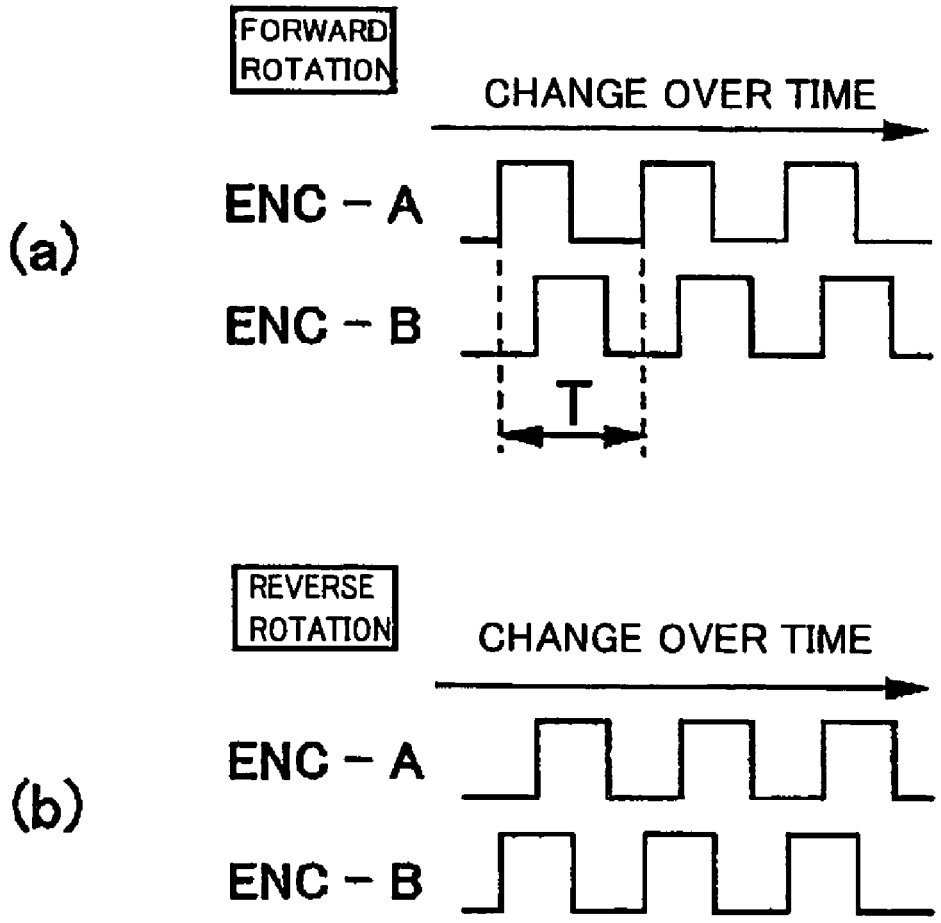
FIG. 17 shows timing charts of the waveforms of two output signals of the linear encoder 1011 when the CR motor is rotating forward, and when it is rotating in reverse.

FIG. 17 is a timing chart showing waveforms of two output signals of the linear encoder 1011 when the CR motor is rotating forward and when it is rotating in reverse.

As shown in FIG. 17(*a*) and FIG. 17(*b*), the phases of the pulse ENC-A and the pulse ENC-B are misaligned by 90 degrees both when the CR motor is rotating forward and when it is rotating in reverse. When the CR motor 1030 is rotating forward, that is, when the carriage 1028 is moving in the main-scanning direction, then, as shown in FIG. 17(*a*), the phase of the pulse ENC-A leads the phase of the pulse ENC-B by 90 degrees. On the other hand, when the CR motor 1030 is rotating in reverse, then, as shown in FIG. 17(*b*), the phase of the pulse ENC-A is delayed by 90 degrees with respect to the phase of the pulse ENC-B. A single period T of the pulse ENC-A and the pulse ENC-B is equivalent to the time during which the carriage 1028 is moved by the slit spacing of the linear encoder code plate 1012.

Then, the rising edge and the rising edge of the output pulses ENC-A and ENC-B of the linear encoder 1011 are detected, and the number of detected edges is counted. The rotational position of the CR motor 1030 is obtained based on the number that is calculated. With respect to the calculation, when the CR motor 1030 is rotating forward, a "+1" is added every time an edge is detected, and when the CR motor 1030 is rotating in reverse, a "−1" is added every time an edge is detected. Each period of the pulses ENC-A and ENC-B is equal to the time from when one slit of the linear encoder code plate 1012 passes through the linear encoder 1011 to when the next slit passes through the linear encoder 1011, and the phases of the pulse ENC-A and the pulse ENC-B are misaligned by 90 degrees. Accordingly, a count value "1" in the above-described calculation corresponds to ¼ of the slit spacing of the linear encoder code plate 1012. Therefore, if the count value is multiplied by ¼ of the slit spacing, then the amount that the CR motor 1030 has moved from the rotational position corresponding to the count value "0" can be obtained based on this product. The resolution of the linear encoder 1011 at this time is ¼ the slit spacing of the linear encoder code plate 1012.

On the other hand, the rotary encoder 1013 for the PF motor 1031 has the same configuration as the linear encoder 1011, except that the rotary encoder code plate 1014 is a rotation disk that rotates in conjunction with rotation of the PF motor 1031. The rotary encoder 1013 outputs two output pulses ENC-A and ENC-B, and based on this output the amount of movement of the PF motor 1031 can be obtained.

Example of Electric Configuration of the Color Inkjet Printer

Figure 18:
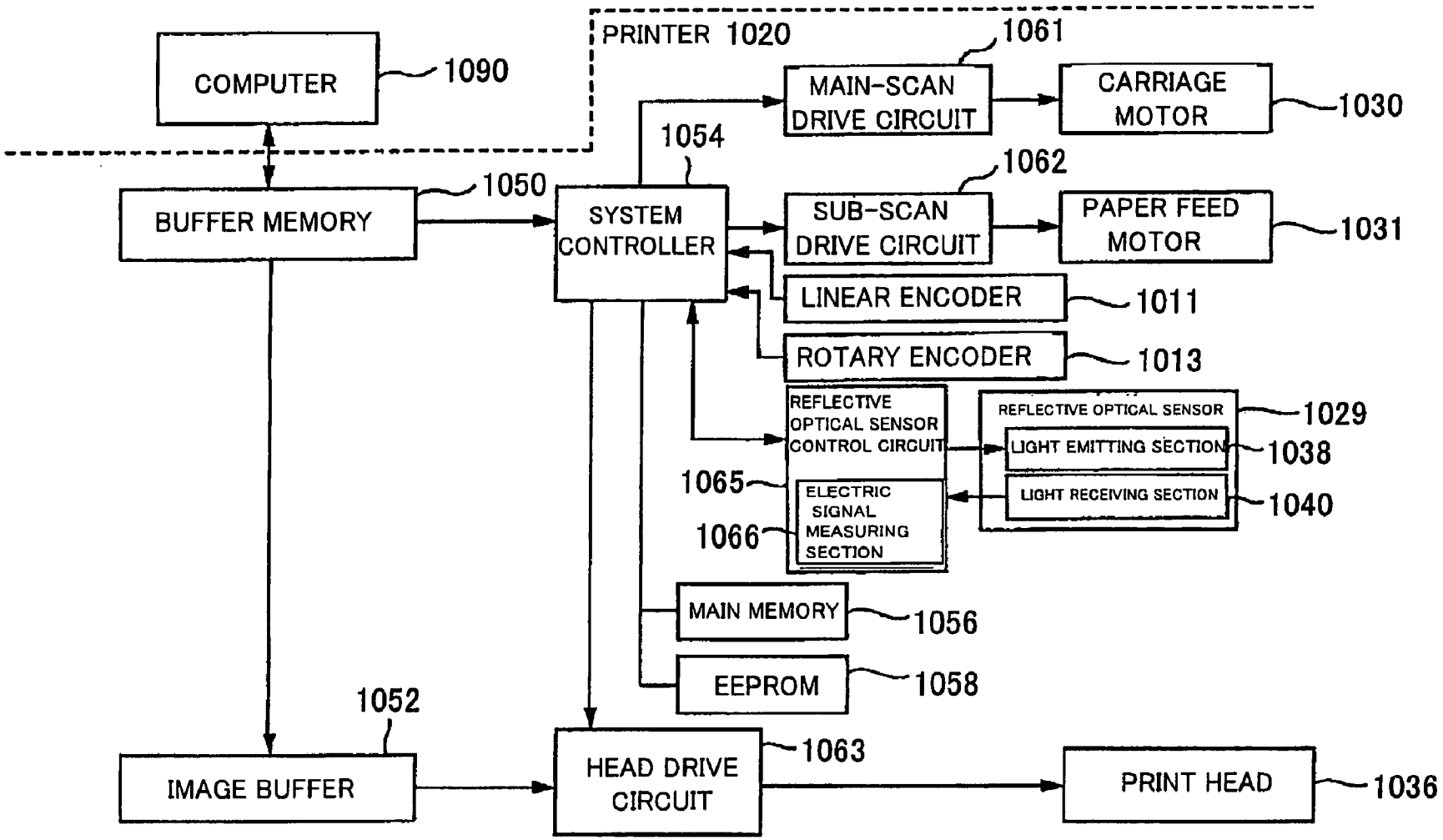
FIG. 18 is a block diagram showing an example of an electric configuration of the color inkjet printer 1020.

FIG. 18 is a block diagram showing an example of the electric configuration of the color inkjet printer 1020. The color inkjet printer 1020 is provided with a buffer memory 1050 for receiving signals supplied from the computer 1090, an image buffer 1052 for storing print data, a system controller 1054 for controlling the overall operation of the color inkjet printer 1020, a main memory 1056, and an EEPROM 1058. The system controller 1054 is connected to a main-scan drive circuit 1061 for driving the carriage motor 1030, a sub-scan drive circuit 1062 for driving the paper feed motor 1031, a head drive circuit 1063 for driving the print head 1036, a reflective optical sensor control circuit 1065 for controlling the light emitting section 1038 and the light receiving section 1040 of the reflective optical sensor 1029, the above-described linear encoder 1011, and the above-described rotary encoder 1013. Also, the reflective optical sensor control circuit 1065 is provided with an electric signal measuring section 1066 for measuring the electric signals that are converted from the reflected light received by the light receiving section 1040.

The print data that are transferred from the computer 1090 are temporarily held in the buffer memory 1050. In the color inkjet printer 1020, the system controller 1054 reads necessary information from the print data in the buffer memory 1050, and based on this information, sends control signals to the main-scan drive circuit 1061, the sub-scan drive circuit 1062, and the head drive circuit 1063, for example.

The image buffer 1052 stores print data for a plurality of color components that are received by the buffer memory 1050. The head drive circuit 1063 reads the print data of each color components from the image buffer 1052 in accordance with the control signals from the system controller 1054, and drives the nozzle arrays for each color provided in the print head 1036 in correspondence with the print data.

Example of Nozzle Arrangement of the Print Head

Figure 19:
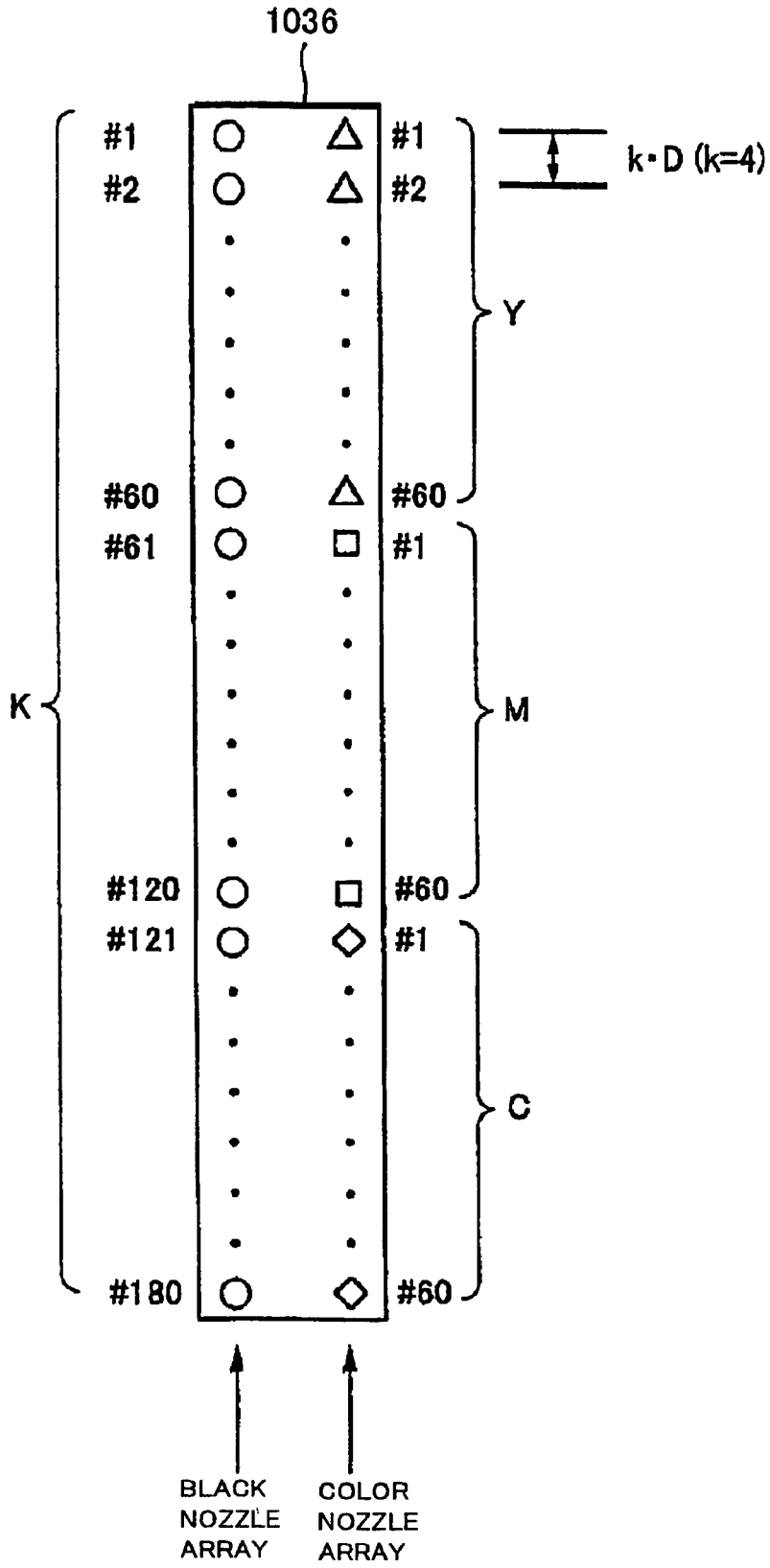
FIG. 19 is an explanatory diagram showing the nozzle arrangement on the bottom surface of a print head 1036.

FIG. 19 is an explanatory diagram showing the nozzle arrangement in a lower surface of the print head 1036. The print head 1036 has a black nozzle array and a color nozzle array, each arranged in a straight line along the sub-scanning direction. In this specification, a "nozzle array" is referred to also as a "nozzle group".

The black nozzle array (shown by white circles) has 180 nozzles #1 to #180. These nozzles #1 to #180 are arranged at a predetermined nozzle pitch k·D along the sub-scanning direction. Here, D is the dot pitch in the sub-scanning direction, and k is an integer. The dot pitch D in the sub-scanning direction is equal to the pitch of main scanning lines (raster lines). Herein below, the integer k for indicating the nozzle pitch k·D is referred to simply as the "nozzle pitch k". The unit of the nozzle pitch k is in "dots", and this refers to the dot pitch in the sub-scanning direction.

In the example of FIG. 19, the nozzle pitch k is four dots. However, the nozzle pitch k may be set to be any integer.

The color nozzle array includes a yellow nozzle group Y (shown by white triangles), a magenta nozzle group M (shown by white squares), and a cyan nozzle group C (shown by white rhombuses). Note that, in this specification, the nozzle group for chromatic color ink is also referred to as "chromatic color nozzle group". Each chromatic color nozzle group has 60 nozzles #1 to #60. Further, the nozzle pitch of the chromatic color nozzle group is the same as the nozzle pitch k of the black nozzle array. The nozzles of the chromatic color nozzle group are arranged in the same sub-scanning position as the nozzles of the black nozzle array.

At the time of printing, ink droplets are ejected from each nozzle while the print head 1036 is moving with the carriage 1028 at a constant speed in the main scanning direction. However, depending on the print mode, not all nozzles are always used, and there is also a case where only some nozzles are used.

First Embodiment

Figure 20:
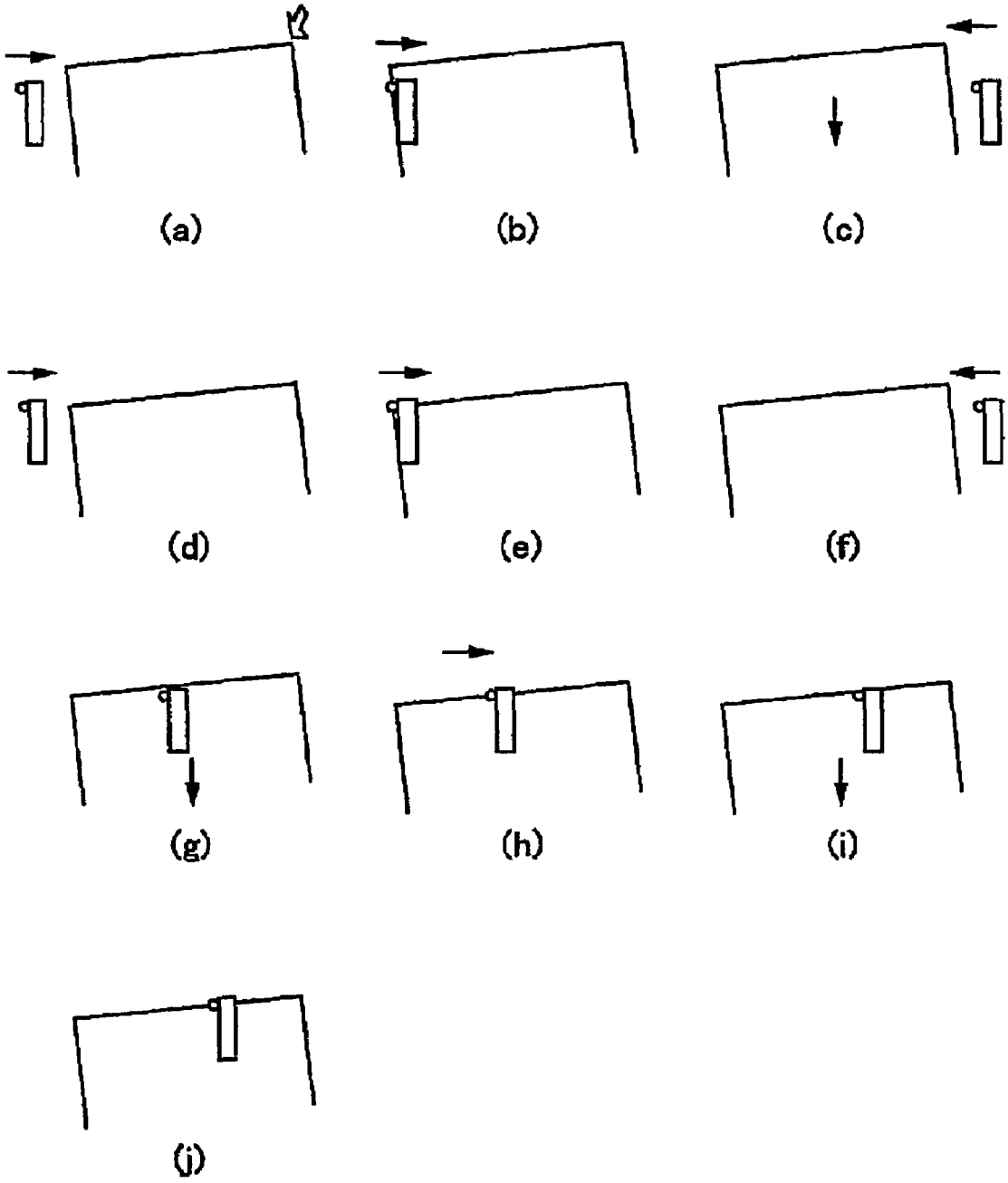
FIG. 20 is a diagram that schematically shows the positional relationship of the print head 1036, the reflective optical sensor 1029, and the print paper P.
Figure 21:
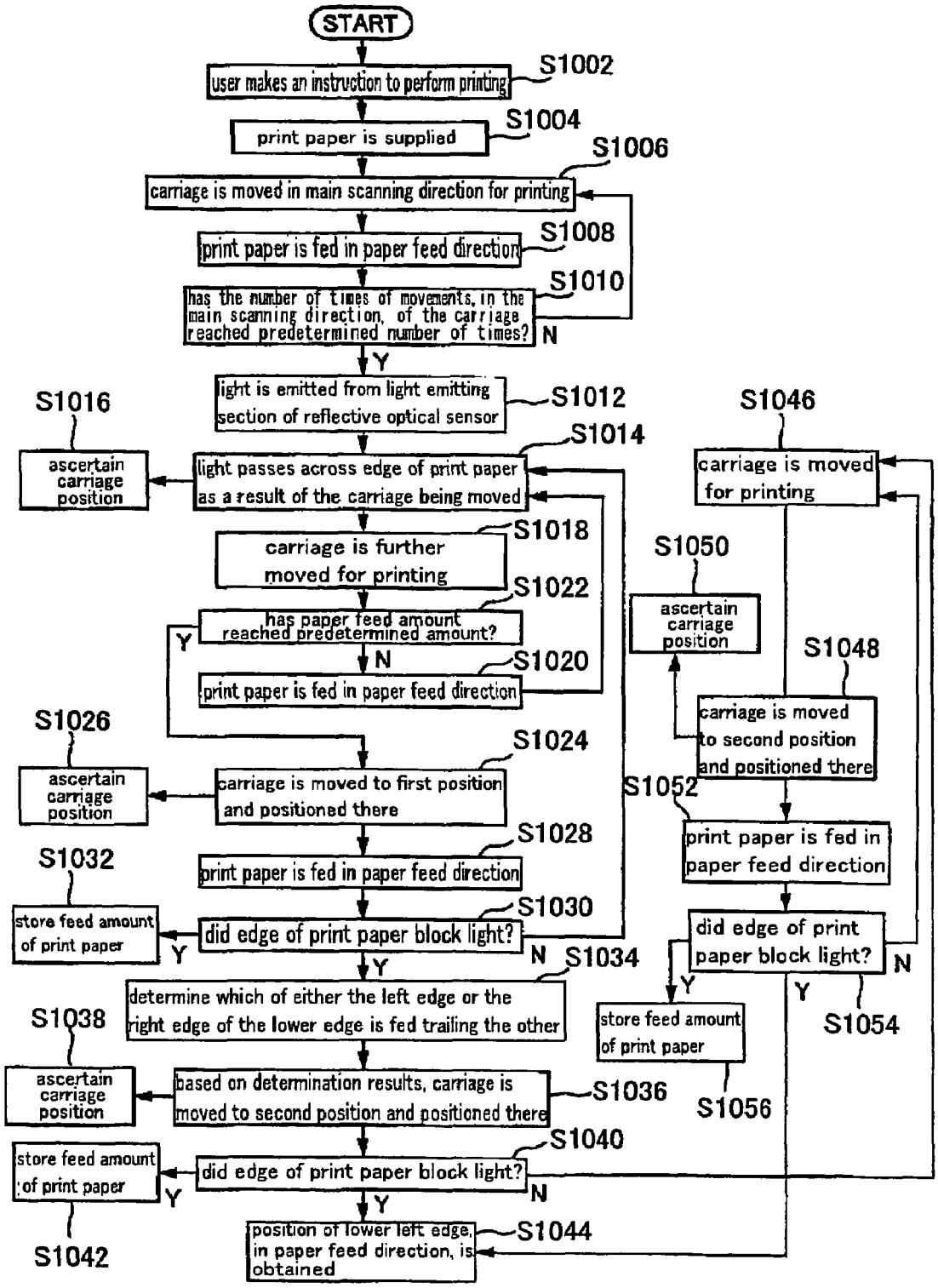
FIG. 21 is a flowchart for describing a first embodiment of a second aspect.

Next, using FIG. 20 and FIG. 21, a first embodiment of the present invention is described. FIG. 20 is a diagram schematically showing positional relationships of the print head 1036, the reflective optical sensor 1029, and the print paper P. FIG. 21 is a flowchart for explaining the first embodiment.

First, the user instructs printing through the application program 1095 and the like (step S1002). When the application program 1095 which has received this instruction issues a print order, the printer driver 1096 of the computer 1090 receives image data from the application program 1095, and converts this data into print data PD which includes raster data that indicates the state in which dots are to be formed in each main scanning and data that indicates a sub-scanning feed amount. Further, the printer driver 1096 supplies the print data PD together with various commands COM to the color inkjet printer 1020. After the color inkjet printer 1020 receives these data with the buffer memory 1050, these data are sent to the image buffer 1052 or the system controller 1054.

Further, the user may give instructions through the user interface display module 1101 about the size of the print paper P or that borderless printing is to be performed. The instruction by the user is received by the user interface display module 1101, and sent to the UI printer interface module 1102. The UI printer interface module 1102 interprets the instructed orders, and sends a command COM to the color inkjet printer 1020. After the color inkjet printer 1020 receives the command COM with the buffer memory 1050, it sends the command to the system controller 1054.

The color inkjet printer 1020, for example, drives the paper feed motor 1031 with the sub-scan drive circuit 1062 based on an order sent to the system controller 1054 to supply the print paper P (step S1004). Then, while feeding the print paper P in the paper feed direction, the system controller 1054 moves the carriage 1028 in the main scanning direction and ejects ink from the print head 1036 provided on the carriage 1028 to perform borderless printing (step S1006, step S1008). It should be noted that feeding of the print paper P in the paper feed direction is performed by driving the paper feed motor 1031 with the sub-scan drive circuit 1062, the movement of the carriage 1028 in the main scanning direction is performed by driving the carriage motor 1030 with the main-scan drive circuit 1061, and the ejection of ink from the print head 1036 is performed by driving the print head 1036 with the head drive circuit 1063.

The color inkjet printer 1020 continuously performs the operations of step S1006 and step S1008, but when, for example, the number of times of movements of the carriage 1028 in the main scanning direction has reached a predetermined number of times (step S1010), the following operation is performed from the next movement in the main scanning direction of the carriage 1028.

The system controller 1054 controls the reflective optical sensor 1029, which is provided on the carriage 1028, with the reflective optical sensor control circuit 1065, and light is emitted from the light emitting section 1038 of the reflective optical sensor 1029 toward the platen 1026 (step S1012).

Next, as shown in FIG. 20(*a*) and FIG. 20(*b*), the system controller 1054 drives the CR motor 1030 to move the carriage 1028. The light emitted from the light emitting section 1038 eventually passes across an edge of the print paper P, as shown in FIG. 20(*b*) (step S1014). The target on which the light emitted from the light emitting section 1038 is incident changes at this time from the platen 1026 to the print paper P, and therefore, the magnitude of the electric signal that is an output value of the light receiving section 1040 of the reflective optical sensor 1029, which received the reflected light, changes. The magnitude of the electric signal is then measured by the electric signal measuring section 1066, and it is detected that an edge of the print paper P has passed across the light.

The amount of movement of the CR motor 1030 from its reference position is then obtained based on the output pulses of the linear encoder 1011, and this amount of movement, that is, the position of the carriage 1028 (hereinafter also referred to as position X1), is stored (step S1016).

As shown in FIG. 20(*b*) and FIG. 20(*c*), the system controller 1054 then drives the CR motor 1030 and further moves the carriage 1028 in the main scanning direction to perform printing on the print paper P (step S1018).

Next, as shown in FIG. 20(*c*) and FIG. 20(*d*), the system controller 1054 drives the CR motor 1030 to move the carriage 1028 and also drives the paper feed motor 1031 to feed the print paper P by a predetermined amount (step S1020).

Next, the color inkjet printer 1020 repeats the above-described operations of step S1014 through step S1020.

In other words, as shown in FIG. 20(*d*) and FIG. 20(*e*), the system controller 1054 drives the CR motor 1030 and moves the carriage 1028. The light emitted from the light emitting section 1038 eventually passes across an edge of the print paper P, as shown in FIG. 20(*e*) (step S1014). The target on which the light emitted from the light emitting section 1038 is incident changes at this time from the platen 1026 to the print paper P, and therefore, the magnitude of the electric signal that is an output value of the light receiving section 1040 of the reflective optical sensor 1029, which received the reflected light, changes. The magnitude of the electric signal is then measured by the electric signal measuring section 1066, and it is detected that an edge of the print paper P has passed across the light.

The amount of movement of the CR motor 1030 from its reference position is then obtained based on the output pulses of the linear encoder 1011, and this amount of movement, that is, the position of the carriage 1028 (hereinafter also referred to as position X2) is stored (step S1016).

As shown in FIG. 20(*e*) and FIG. 20(*f*), the system controller 1054 then drives the CR motor 1030 and further moves the carriage 1028 in the main scanning direction to perform printing on the print paper P (step S1018).

Next, the system controller 1054 drives the CR motor 1030 to move the carriage 1028 and also drives the paper feed motor 1031 to feed the print paper P by a predetermined amount (step S1020).

The color inkjet printer 1020 continuously performs the operations of step S1014, step S1016, step S1018, and step S1020 in this way, but when, for example, the paper feed amount of the print paper P has reached a predetermined amount (step S1022), the following operation is performed.

First, as shown in FIG. 20(*f*) and FIG. 20(*g*), the system controller 1054 drives the CR motor 1030 and moves the carriage 1028 to a predetermined position (hereinafter also referred to as a first position), and the carriage is positioned there (step S1024). Then, the amount of movement of the CR motor 1030 from its reference position is obtained based on the output pulses of the linear encoder 1011, and this amount of movement, that is, the first position of the carriage 1028 is stored (step S1026).

Next, as shown in FIG. 20(*g*) and FIG. 20(*h*), the system controller 1054 drives the paper feed motor 1031 to feed the print paper P by a predetermined amount (step S1028).

Here, if the lower edge of the print paper P blocks the light emitted from the light emitting section 1038 before the predetermined amount of paper feed is finished as shown in FIG. 20(*h*) (step S1030), the target on which the light emitted from the light emitting section 1038 is incident changes from the print paper P to the platen 1026, and therefore, the magnitude of the electric signal that is an output value of the light receiving section 1040 of the reflective optical sensor 1029, which received the reflected light, changes. The magnitude of the electric signal is then measured by the electric signal measuring section 1066, and it is detected that the lower edge of the print paper P has passed across the light. Also, at this time, the system controller 1054 obtains the amount of movement of the PF motor 1031 from its reference position based on the output pulses of the rotary encoder 1013, and this amount of movement, that is, the feed amount of the print paper P is stored (step S1032).

Conversely, if the lower edge of the print paper P does not block the emitted light before the predetermined amount of paper feed is finished (step S1030), the process advances to the above-described step S1014.

Explanation will now continue in regard to the case in which the lower edge of the print paper P blocks the emitted light before the predetermined amount of paper feed is finished. The system controller 1054 uses the information concerning the position of the carriage 1028 stored in step S1016 and determines which of either one of the left edge or the right edge of the lower edge is fed trailing the other in the paper feed direction (step S1034).

For example, with reference to FIG. 20(*b*) and FIG. 20(*e*), the above-mentioned position X1 is positioned further to the right in the main scanning direction in the figure than the above-mentioned position X2. Accordingly, in this case, it is acknowledged that the left edge of the lower edge (shown as the upper right edge of the print paper P in the figure) is fed trailing in the paper feed direction. Conversely, if the position X1 is positioned further to the left in the figure than the position X2, the right edge of the lower edge is fed trailing in the paper feed direction.

It should be noted that although the positions X1 and X2 are stored in step S1016 as described above, since step S1014 through step S1020 form a loop as can be seen in FIG. 21, the position of the carriage 1028 may be stored repetitively in step S1016. The position X1 and the position X2 may be any of these stored positions.

Based on the determined results, the carriage 1028 is then moved from the first position to a predetermined position (hereinafter also referred to as a second position), and the carriage is positioned there. In other words, it is determined, based on the above-described determination results, whether the second position is to be set downstream or upstream in the main scanning direction with respect to the first position, and the setting is made by moving the carriage 1028 (step S1036). To describe this in more detail, as shown in FIG. 20(*h*) and FIG. 20(*i*), if it is determined that the left edge of the lower edge (shown as the upper right edge of the print paper P in the figures) is fed trailing in the paper feed direction, then the second position is set downstream in the main scanning direction with respect to the first position (here, the main scanning direction is the direction from left to right in the figure). Conversely, if it is determined that the right edge of the lower edge is fed trailing in the paper feed direction, the second position is set upstream in the main scanning direction with respect to the first position. Then, the amount of movement of the CR motor 1030 from its reference position is obtained based on the output pulses of the linear encoder 1011, and this amount of movement, that is, the second position of the carriage 1028 is stored (step S1038).

The paper is fed repeatedly for a predetermined amount as shown in FIGS. 20(*i*) and 20(*j*), and then, if the lower edge of the print paper P blocks the light emitted from the light emitting section 1038 before finishing the predetermined amount of paper feed as shown in FIG. 20(*j*) (step S1040), then the target on which the light emitted from the light emitting section 1038 is incident changes from the print paper P to the platen 1026, and therefore, the magnitude of the electric signal that is an output value of the light receiving section 1040 of the reflective optical sensor 1029, which received the reflected light, changes. The magnitude of the electric signal is then measured by the electric signal measuring section 1066, and it is detected that the lower edge of the print paper P has passed across the light. Also, at this time, the system controller 1054 obtains the amount of movement of the PF motor 1031 from its reference position based on the output pulses of the rotary encoder 1013, and this amount of movement, that is, the feed amount of the print paper P is stored (step S1042).

The converse case in which the lower edge of the print paper P does not block the emitted light before the predetermined amount of paper feed is finished (step S1040) will be discussed later.

Explanation will now continue in regard to the case in which the lower edge of the print paper P blocks the emitted light before the predetermined amount of paper feed is finished (step S1040). From the first position of the carriage 1028 stored in step S1026, the second position of the carriage 1028 stored in step S1038, the feed amount of the print paper P stored in step S1032, and the feed amount of the print paper P stored in step S1042, the system controller 1054 obtains the position, in the paper feed direction, of either one of the left edge or the right edge of the lower edge that is fed trailing the other in the paper feed direction.

As mentioned earlier, there are cases in which the print paper P is supplied or fed in a skewed (diagonal) manner. Strictly speaking, in such cases, either the left edge or the right edge of the lower edge is fed as the most trailing edge in the paper feed direction. In the present embodiment, as shown by the hollow white arrow in FIG. 20(*a*), the left edge of the lower edge (hereinafter also referred to as the lower left edge) is fed as the most trailing edge in the paper feed direction.

Figure 22:
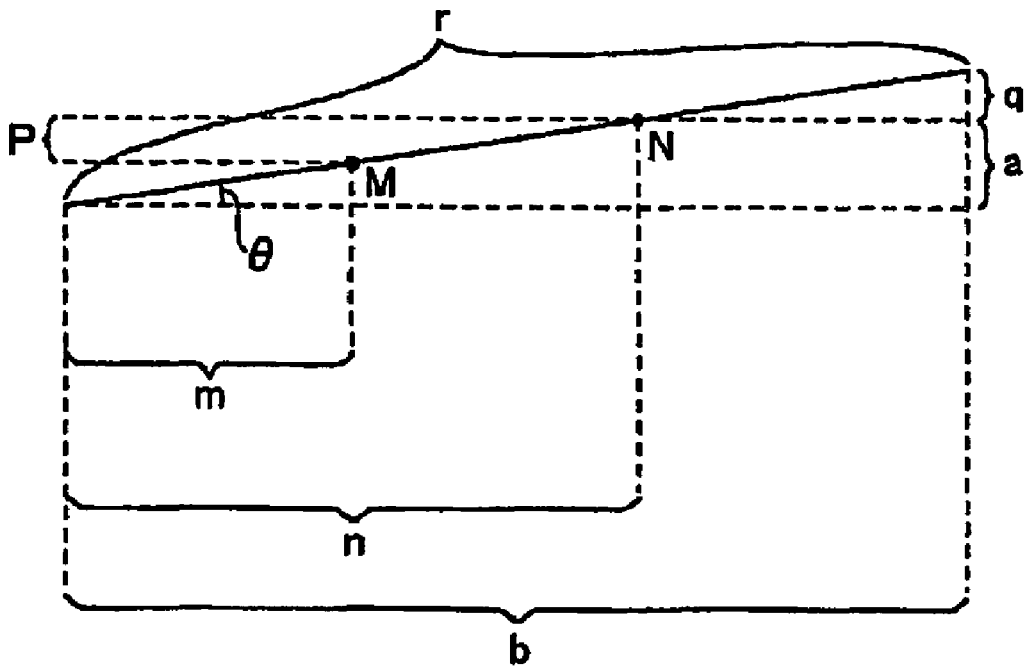
FIG. 22 is a diagram for describing an example of a method for obtaining the position, in the paper feed direction, of either one of the left edge or the right edge of the lower edge of the print paper P that is fed trailing the other in the paper feed direction.

This is explained in greater detail using FIG. 22. FIG. 22 is a diagram for describing an example of a method for obtaining the position, in the paper feed direction, of either one of the left edge or the right edge of the lower edge of the print paper P that is fed trailing the other in the paper feed direction.

The solid straight line shown in the figure which is inclined toward the upper right direction indicates the lower edge of the print paper P. Further, the left end of the line shown in the figure indicates the right edge of the lower edge of the print paper P (hereinafter also referred to as the lower right edge), and the right end of the line indicates the lower left edge of the print paper P. The reason why the right and left of the line and the right and left of the lower edge of the print paper P are reversed in position is because the paper feed direction is in the direction from the upper side to the lower side of the figure.

Further, as shown in the figure, the first position, which is stored in step S1026, for when the first position of the carriage 1028 is at point M is assumed to be numerical value m. Similarly, the second position, which is stored in step S1038, for when the second position of the carriage 1028 is at point N is assumed to be numerical value n. Note that, for convenience, both numerical values m and n are values that adopt the position, in the main scanning direction, of the lower right edge of the print paper P as a reference position; this, however, is not a limitation, and other positions may be adopted.

Further, as regards the paper feed direction, the difference p between the positions of point M and point N in the figure directly indicates the difference between the feed amount of the print paper P stored in step S1032 and the feed amount of the print paper P stored in step S1042, because the carriage 1028 moves only in the main scanning direction. Therefore, it becomes possible to obtain the difference p from the numerical values stored in step S1032 and step S1042.

Next, the position, in the paper feed direction, of either one of the left edge or the right edge of the lower edge that is fed trailing the other in the paper feed direction (the lower left edge in this embodiment) is obtained from the numerical values m, n, and p. As shown in the figure, this position is expressed by, for example, a difference q relative to the second position (point N) in the paper feed direction. The following describes a method of obtaining q.

First, the skew θ of the print paper P is obtained. As is clear from the figure, the relationship $\tan\theta=p/(n-m)$ holds true, which yields $\theta=\tan-1(p/(n-m))$.

Next, the distance a in the paper feed direction shown in FIG. 22 is obtained. As is clear from the figure, the relationship $(a-p)/a=m/n$ holds true, which yields $a=n\cdot p/(n-m)$.

Next, the distance b in the main scanning direction shown in FIG. 22 is obtained. The width (of the lower edge) of the print paper is already known, and when this is given as r, then $b=r\cdot\cos\theta$. Thus, it is possible to obtain b by substituting the already obtained value for θ.

Moreover, as is clear from the figure, the relationship $n/(b-n)=a/q$ holds true, which yields $q=a\cdot(b-n)/n$. Thus, it is possible to obtain q by substituting, into this equation, the already obtained values a and b.

In this way, the position, in the paper feed direction, of either one of the left edge or the right edge of the lower edge that is fed trailing the other in the paper feed direction (the lower left edge in this embodiment) can be obtained from the numerical values stored in step S1026, step S1032, step S1038, and step S1042 (step S1044).

The following is an explanation of the case in which the lower edge of the print paper P does not block the emitted light before the predetermined amount of paper feed is finished in step S1040.

In this case, the position, in the paper feed direction, of either one of the left edge or the right edge of the lower edge that is fed trailing the other in the paper feed direction (the lower left edge in this embodiment) is not obtained, and after the predetermined amount of paper feed is finished, ink is ejected from the print head 1036 while making the carriage 1028 move in the main scanning direction to carry out printing on the print paper P (step S1046).

Then, in the next feed of the print paper P, the system controller 1054 drives the CR motor 1030 to move the carriage 1028 to the second position, and the carriage is positioned there (step S1048). The amount of movement of the CR motor 1030 from its reference position is then obtained based on the output pulses of the linear encoder 1011, and this amount of movement, that is, the second position of the carriage 1028 is stored (step S1050).

Next, the system controller 1054 drives the paper feed motor 1031 to feed the print paper P by a predetermined amount (step S1052).

Then, similar to step S1040, it is determined whether or not the lower edge of the print paper P blocks the light emitted from the light emitting section 1038 before the predetermined amount of paper feed is finished (step S1054). If the lower edge of the print paper P has blocked the emitted light (step S1054), then the system controller 1054 detects that the lower edge of the print paper P has passed across the light according to the above-described method and stores the feed amount of the print paper P (step S1056).

Conversely, if the lower edge of the print paper P does not block the emitted light (step S1054), the procedure advances to the above-described step S1046.

Further, in the case in which the lower edge of the print paper P has blocked the emitted light before the predetermined amount of paper feed is finished (step S1054), the system controller 1054 uses the already explained method to obtain the position, in the paper feed direction, of either one of the left edge or the right edge of the lower edge that is fed trailing the other in the paper feed direction, based on the first position of the carriage 1028 stored in step S1026, the second position of the carriage 1028 stored in step S1050, the feed amount of the print paper P stored in step S1032, and the feed amount of the print paper P stored in step S1056 (step S1044).

It should be noted that a program for carrying out the above-described process is stored in the EEPROM 1058, and the program is executed by the system controller 1054.

As described in the section of the Background Art, since there are cases in which the print paper P is supplied (or fed) in a skewed (diagonal) manner, the position of the lower edge that has been ascertained by emitting light from alight-emitting diode or the like and simply detecting a change in the output value of a light-receiving sensor such as a photodiode caused by the print paper, which is being fed, blocking the light may, strictly speaking, not be the most trailing position in the paper feed direction, and therefore a problem may occur with regard to the precision with which the printing apparatus ascertains the lower edge position.

In view of the above, it becomes possible to solve the above-mentioned problem by detecting a change in the output value of the light-receiving sensor caused by the lower edge of the print paper P blocking the light at a plurality of positions, and based on the detection results, obtaining the position, in the paper feed direction, of either one of the left edge or the right edge of the lower edge that is fed trailing the other in the paper feed direction, thus precisely ascertaining the position of the lower edge of the print paper P.

It should be noted that, in the above description, the position of either one of the left edge or the right edge of the lower edge that is fed trailing the other in the paper feed direction was obtained based on positions, in the main scanning direction, of the first position and the second position. Broadly speaking, however, the case of obtaining the above based on the position in the main scanning direction of the first position or the position in the main scanning direction of the second position, and the distance between these two positions, is included in the case of obtaining the above based on positions in the main scanning direction of the first position and the second position.

Further, in the above description, the amounts of movement of the PF motor 1031 from its reference position were obtained and these movement amounts were stored as the feed amounts of the print paper P in step S1032 and step S1042, and the difference in the feed amounts was regarded as the amount of the print paper fed from when the change in the output value of the light-receiving sensor was detected at the first position until when the change in the output value of the light-receiving sensor was detected at the second position. The feed amount of the print paper, however, may be obtained by using the position of the PF motor 1031 in step S1032 as the reference position for obtaining the amount of movement of the PF motor 1021 in step S1042. The same applies for the above-described procedure in which the predetermined paper feed amount is obtained from the difference in the numerical values stored in step S1032 and step S1056.

Further, a reflective optical sensor was used in the above description, but there is no limitation to this. For example, the light emitting section and the light receiving section may be arranged so that they oppose each other in a direction perpendicular to both the main scanning direction and the sub-scanning direction and so that the medium to be printed is inserted between the light emitting section and the light receiving section.

Further, in the above, the first position and the second position were regarded as the predetermined positions; the predetermined positions, however, may be at any position. Furthermore, when the first position and the second position are regarded as the predetermined positions, the subsequent procedures for storing the first position and the second position, that is, step S1026 and step S1038, as well as step S1050, may be omitted. Furthermore, even when the second position is an arbitrary position, it is in no way always necessary to store the second position in step S1050 if the second position is stored in step S1038.

Also, in the above description, after the movements of the carriage 1028 in the main scanning direction has reached a predetermined number of times in step S1010, the detection for the edge of the print paper P passing across the light is started, but this is not a limitation. For example, detection may be started from the first movement of the carriage 1028 in the main scanning direction, and it is also possible to minimize the number of times of detections by obtaining, through computation etc., an ideal detection timing. The same is also true for step S1022.

Furthermore, in the above description, as shown in FIG. 20(*b*) and FIG. 20(*e*), detection is made for the light passing across the right edge (left edge in the figures) of the print paper P, but it is also possible to detect the light passing across the left edge (right edge in the figures). Further, it is also possible to detect both the right edge and the left edge to increase the precision of the determination.

Other Embodiments

A printing apparatus etc. according to the present invention was described above according to an embodiment thereof. The foregoing embodiment of the invention, however, is for the purpose of facilitating understanding of the present invention and is not to be interpreted as limiting the present invention. The invention can of course be altered and improved without departing from the gist thereof and includes equivalents thereof.

Further, print paper was described as an example of a printing medium, but a film, a cloth, a thin metal plate, and the like may be used as a printing medium.

Further, it is possible to provide a computer system that has a computer unit, a display device which is connectable to the computer unit, and a printer according to the above described embodiment which is connectable to the computer unit, and an input device such as a mouse or a keyboard, a flexible disk drive device, and a CD-ROM drive device that are provided if necessary. A computer system configured in this way will be superior to conventional computer systems as a whole.

The printer according to the above-described embodiment may have some of the functions or the mechanisms of each of the computer unit, the display device, the input device, the flexible disk drive device, and the CD-ROM drive device. For example, the printer may have a structure comprising an image processing section for performing image processing, a display section for performing various displays, and a recording media mounting section for mounting and dismounting a recording medium in which image data captured by a digital camera or the like are recorded.

The above embodiment describes a color inkjet printer, but the present invention may also be applied to monochrome inkjet printers and may also be applied to printers other than inkjet printers. The present invention is generally applicable to printing apparatuses that print on media to be printed, and may also be applied to facsimile devices and copy machines, for example.

However, as high quality printing results are particularly demanded of so-called inkjet printing apparatuses, which carry out printing by ejecting ink from a print head, the advantages of the above-described means become much greater.

It should be noted that, in the above-described embodiment, the changes in the output value that are caused by the lower edge of the print paper blocking the light were detected at a plurality of positions by moving the light emitting section and the light receiving section in the main scanning direction, but this is not a limitation. For example, it is also possible to provide a plurality of reflective optical sensors and to detect the changes in the output values with each of these reflective optical sensors.

However, the above-described embodiment is preferable in terms that it is possible to reduce the number of reflective optical sensors to be provided by moving the light emitting section and the light receiving section in the main scanning direction.

Further, in the above-described embodiment, the changes in the output value of the light-receiving sensor that are caused by the lower edge of the print paper P blocking the light were detected at a first position and a second position which are different from each other in the main scanning direction; and the position of either one of the left edge or the right edge of the lower edge that is fed trailing the other in the paper feed direction was obtained based on a position, in the main scanning direction, of the first position, a position, in the main scanning direction, of the second position, and an amount of the medium to be printed fed from when a change in the output value is detected at the first position until when a change in the output value is detected at the second position; this, however, is not a limitation.

The above-mentioned embodiment, however, is more preferable in terms that, in this way, the number of times for detecting the changes in the output value of the light receiving sensor can be kept at a minimum, and the procedure can be simplified.

Also, in the above-described embodiment, which of either the left edge or the right edge of the lower edge of the print paper is fed trailing in the paper feed direction was determined before moving the light-emitting section and the light-receiving section from the first position, and based on a result of the determination, whether to set the second position downstream or upstream in the main scanning direction with respect to the first position was determined; this, however, is not a limitation. For example, after the change in the output value of the light receiving section is detected at the first position, the light emitting section and the light receiving section may be moved either upstream or downstream in the main scanning direction from the first position; and, according to the output value of the light receiving section that has received light emitted by the light emitting section, if it is determined that the light is incident on the print paper P, then the second position may be set on a same side, with respect to the first position, as the side where the determination is made, and if it is determined that the light is not incident on the print paper P, then the second position may be set on an opposite side, with respect to the first position, from the side where the determination is made.

If the second position is set, without carrying out either of the above-mentioned procedures, on the side where the target of incidence would not be on the print paper if the light were emitted, then an inconvenience would occur in which it would be necessary to feed the print paper backwards in order for the lower edge of the print paper to block the light at the second position. The two methods described above are in common in terms as being able to avoid this inconvenience, but the latter method is inefficient in terms that a temporary position has to be adopted when moving from the first position to the second position. Accordingly, the above-described embodiment is more preferable in terms that this inefficiency can be avoided.

Also, in the above-described embodiment, a change in the output value of the light receiving section that is caused by the light, which is emitted by the light emitting section, passing across an edge of the print paper was detected to specify the position of the edge by making the print paper stationary and moving the light emitting section in the main scanning direction; and based on this position, which of either the left edge or the right edge of the lower edge of the print paper is fed trailing in the paper feed direction was determined. This, however, is not a limitation.

The above-described embodiment, however, is more preferable in terms that, since the operation of making the print paper stationary and moving the light emitting section in the main scanning direction is in common with the operation of carrying out printing on the print paper, the information for making the determination can be obtained efficiently.

Also, in the above-described embodiment, after detecting a change in the output value of the light receiving section that is caused by the light, which is emitted by the light emitting section, passing across an edge of the print paper and specifying the position of the edge by making the print paper stationary and moving the light emitting section in the main scanning direction, the print paper was fed, a change in the output value of the light receiving section was again detected to specify the position of an edge, and which of either the left edge or the right edge of the lower edge of the print paper is fed trailing in the paper feed direction was determined based on the positions of the two edges that have been specified. This, however, is not a limitation.

The above-described embodiment, however, is more preferable in terms that, since in this way the amount of information for making the determination increases, it is possible to precisely determine which of either the left edge or the right edge of the lower edge is fed trailing in the paper feed direction.

Furthermore, in the above-described embodiment, the light emitting section and the light receiving section were provided on a movable carriage that is provided with a print head for forming dots, but this is not a limitation. For example, the carriage and the light emitting section and light receiving section may be so configured that they are separately movable in the main scanning direction.

However, the above-described embodiment is preferable in terms that, in this way, it is possible to share the moving mechanisms of the carriage, the light emitting section, and the light receiving section.

Furthermore, borderless printing was carried out in the above-described embodiment, but this is not a limitation.

However, since it is necessary to accurately ascertain the position of the lower edge of the print paper in the case of borderless printing because printing is carried out also on the lower edge of the print paper, and therefore, the advantages obtained by the above-described procedure are greater.

INDUSTRIAL APPLICABILITY

According to the present invention, it becomes possible to achieve a printing apparatus, a method for determining an upper edge of a medium to be printed, a method for determining a lower edge of a medium to be printed, a computer program, and a computer system that are capable of ascertaining, with good precision, the position of an upper edge of a medium to be printed.

What is claimed is:

1. A printing apparatus comprising:

feeding means for feeding, in a predetermined feeding direction, a medium to be printed that has been supplied;

light-emitting means for emitting light; and a light-receiving sensor for receiving light emitted by said light-emitting means, the printing apparatus being capable of detecting a change in an output value of said light-receiving sensor that is caused by said medium to be printed, which has been fed by said feeding means, blocking the light, which has been emitted by said light-emitting means, wherein, by moving said light-emitting means and said light-receiving sensor in a main scanning direction, the printing apparatus detects, at a plurality of positions, changes in said output value that are caused by an upper edge of said medium to be printed blocking said light, and based on a result of the detection, the printing apparatus obtains a position, in said feeding direction, of either one of a left edge or a right edge of said upper edge that is fed leading the other in said feeding direction.

2. A printing apparatus according to claim 1, wherein the printing apparatus ejects ink from a print head to form dots on said medium to be printed.

3. A printing apparatus according to claim 2, wherein:

the printing apparatus detects, at a first position and a second position which are different from each other in the main scanning direction, the changes in said output value that are caused by the upper edge of said medium to be printed blocking said light; and the printing apparatus obtains the position of either one of the left edge or the right edge of said upper edge that is fed leading the other in said feeding direction based on a position, in the main scanning direction, of said first position, a position, in the main scanning direction, of said second position, and an amount of said medium to be printed fed from when a change in said output value is detected at said first position until when a change in said output value is detected at said second position.

4. A printing apparatus according to claim 3, wherein:

after the change in said output value is detected at said first position, the printing apparatus moves said light-emitting means and said light-receiving sensor either upstream or downstream in the main scanning direction from said first position; and according to the output value of said light-receiving sensor that has received light emitted by said light-emitting means, if it is determined that said light is incident on said medium to be printed, then the printing apparatus sets said second position on an opposite side, with respect to said first position, from the side where the determination was made, and if it is determined that said light is not incident on said medium to be printed, then the printing apparatus sets said second position on a same side, with respect to said first position, as the side where the determination was made.

5. A printing apparatus according to claim 1, wherein said light-emitting means and said light-receiving sensor are provided on a movable moving member that is provided with a print head for forming dots.

6. A printing apparatus according to claim 1, wherein the printing apparatus carries out printing on said medium to be printed after feeding said medium to be printed so that either one of the left edge or the right edge of said upper edge that is fed leading the other in said feeding direction reaches a predetermined position.

7. A printing apparatus according to claim 1, wherein the printing apparatus carries out printing with respect to an entire surface of said medium to be printed.

8. A printing apparatus comprising:

feeding means for feeding, in a predetermined feeding direction, a medium to be printed that has been supplied;

light-emitting means for emitting light; and a light-receiving sensor for receiving light emitted by said light-emitting means, the printing apparatus being capable of detecting a change in an output value of said light-receiving sensor that is caused by said medium to be printed, which has been fed by said feeding means, blocking the light, which has been emitted by said light-emitting means, wherein:

said light-emitting means and said light-receiving sensor are provided on a movable moving member that is provided with a print head for ejecting ink to form dots;

by moving said light-emitting means and said light-receiving sensor in a main scanning direction, the printing apparatus detects, at a first position and a second position which are different from each other in the main scanning direction, changes in said output value that are caused by an upper edge of said medium to be printed blocking said light;

the printing apparatus obtains the position of either one of a left edge or a right edge of said upper edge that is fed leading the other in said feeding direction based on a position, in the main scanning direction, of said first position, a position, in the main scanning direction, of said second position, and an amount of said medium to be printed fed from when a change in said output value is detected at said first position until when a change in said output value is detected at said second position;

after the change in said output value is detected at said first position, the printing apparatus moves said light-emitting means and said light-receiving sensor either upstream or downstream in the main scanning direction from said first position, and, according to the output value of said light-receiving sensor that has received light emitted by said light-emitting means, if it is determined that said light is incident on said medium to be printed, then the printing apparatus sets said second position on an opposite side, with respect to said first position, from the side where the determination was made, and if it is determined that said light is not incident on said medium to be printed, then the printing apparatus sets said second position on a same side, with respect to said first position, as the side where the determination was made; and the printing apparatus carries out printing with respect to an entire surface of said medium to be printed by ejecting ink from said print head after feeding said medium to be printed so that either one of the left edge or the right edge of said upper edge that is fed leading the other in said feeding direction reaches a predetermined position.

9. A method for determining an upper edge of a medium to be printed with a printing apparatus that is provided with:

feeding means for feeding, in a predetermined feeding direction, a medium to be printed that has been supplied;

light-emitting means for emitting light; and a light-receiving sensor for receiving light emitted by said light-emitting means, the printing apparatus being capable of detecting a change in an output value of said light-receiving sensor that is caused by said medium to be printed, which has been fed by said feeding means, blocking the light, which has been emitted by said light-emitting means, the method for determining the upper edge of the medium to be printed comprising:

a step of detecting, at a plurality of positions, changes in said output value that are caused by the upper edge of said medium to be printed blocking said light by moving said light-emitting means and said light-receiving sensor in a main scanning direction; and a step of obtaining a position, in said feeding direction, of either one of a left edge or a right edge of said upper edge that is fed leading the other in said feeding direction, based on a result of the detection.

10. A computer program for causing a printing apparatus that is provided with: feeding means for feeding, in a predetermined feeding direction, a medium to be printed that has been supplied; light-emitting means for emitting light; and a light-receiving sensor for receiving light emitted by said light-emitting means, and that is capable of detecting a change in an output value of said light-receiving sensor that is caused by said medium to be printed, which has been fed by said feeding means, blocking the light, which has been emitted by said light-emitting means to detect, at a plurality of positions, changes in said output value that are caused by an upper edge of said medium to be printed blocking said light by moving said light-emitting means and said light-receiving sensor in a main scanning direction; and to obtain a position, in said feeding direction, of either one of a left edge or a right edge of said upper edge that is fed leading the other in said feeding direction, based on a result of the detection.

11. A computer system comprising:

a computer unit; and a printing apparatus that is connectable to said computer unit, the printing apparatus being provided with: feeding means for feeding, in a predetermined feeding direction, a medium to be printed that has been supplied; light-emitting means for emitting light; and a light-receiving sensor for receiving light emitted by said light-emitting means, and the printing apparatus being capable of detecting a change in an output value of said light-receiving sensor that is caused by said medium to be printed, which has been fed by said feeding means, blocking the light, which has been emitted by said light-emitting means, wherein, by moving said light-emitting means and said light-receiving sensor in a main scanning direction, the printing apparatus detects, at a plurality of positions, changes in said output value that are caused by an upper edge of said medium to be printed blocking said light, and based on a result of the detection, the printing apparatus obtains a position, in said feeding direction, of either one of a left edge or a right edge of said upper edge that is fed leading the other in said feeding direction.

12. A printing apparatus comprising:

feeding means for feeding, in a predetermined feeding direction, a medium to be printed that has been supplied;

light-emitting means for emitting light; and a light-receiving sensor for receiving light emitted by said light-emitting means, the printing apparatus being capable of detecting a change in an output value of said light-receiving sensor that is caused by said medium to be printed, which has been fed by said feeding means, blocking the light, which has been emitted by said light-emitting means, wherein the printing apparatus detects, at a plurality of positions, changes in said output value that are caused by a lower edge of said medium to be printed blocking said light, and based on a result of the detection, obtains a position, in said feeding direction, of either one of a left edge or a right edge of said lower edge that is fed trailing the other in said feeding direction.

13. A printing apparatus according to claim 12, wherein the printing apparatus ejects ink from a print head to form dots on said medium to be printed.

14. A printing apparatus according to claim 12, wherein by moving said light-emitting means and said light-receiving sensor in a main scanning direction, the printing apparatus detects, at a plurality of positions, the changes in said output value that are caused by the lower edge of said medium to be printed blocking said light.

15. A printing apparatus according to claim 14, wherein:

the printing apparatus detects, at a first position and a second position which are different from each other in the main scanning direction, the changes in said output value that are caused by the lower edge of said medium to be printed blocking said light; and the printing apparatus obtains the position of either one of the left edge or the right edge of said lower edge that is fed trailing the other in said feeding direction based on a position, in the main scanning direction, of said first position, a position, in the main scanning direction, of said second position, and an amount of said medium to be printed fed from when a change in said output value is detected at said first position until when a change in said output value is detected at said second position.

16. A printing apparatus according to claim 15, wherein:

the printing apparatus determines which of either the left edge or the right edge of said lower edge is fed trailing in said feeding direction before moving said light-emitting means and said light-receiving sensor from said first position; and based on a result of the determination, the printing apparatus determines whether to set said second position downstream or upstream in the main scanning direction with respect to said first position.

17. A printing apparatus according to claim 16, wherein:

by making said medium to be printed stationary and moving said light-emitting means in the main scanning direction, the printing apparatus detects a change in said output value of said light-receiving sensor that is caused by said light, which is emitted by said light-emitting means, passing across an edge of said medium to be printed to specify the position of said edge; and based on the position of said edge that has been specified, the printing apparatus determines which of either the left edge or the right edge of said lower edge is fed trailing in said feeding direction.

18. A printing apparatus according to claim 17, wherein:

the printing apparatus feeds said medium to be printed with said feeding means after specifying the position of said edge;

by making said medium to be printed stationary and moving said light-emitting means in the main scanning direction, the printing apparatus again detects a change in said output value of said light-receiving sensor that is caused by said light, which is emitted by said light-emitting means, passing across an edge of said medium to be printed to specify the position of that edge; and based on the positions of the two edges that have been specified, the printing apparatus determines which of either the left edge or the right edge of said lower edge is fed trailing in said feeding direction.

19. A printing apparatus according to claim 14, wherein said light-emitting means and said light-receiving sensor are provided on a movable moving member that is provided with a print head for forming dots.

20. A printing apparatus according to claim 12, wherein the printing apparatus carries out printing with respect to an entire surface of said medium to be printed.

21. A printing apparatus comprising:

feeding means for feeding, in a predetermined feeding direction, a medium to be printed that has been supplied;

light-emitting means for emitting light; and a light-receiving sensor for receiving light emitted by said light-emitting means, the printing apparatus being capable of carrying out printing with respect to an entire surface of said medium to be printed by ejecting ink from a print head, and detecting a change in an output value of said light-receiving sensor that is caused by said medium to be printed, which has been fed by said feeding means, blocking the light, which has been emitted by said light-emitting means, wherein:

said light-emitting means and said light-receiving sensor are provided on a movable moving member that is provided with the print head for ejecting ink to form dots;

by moving said light-emitting means and said light-receiving sensor in a main scanning direction, the printing apparatus detects, at a first position and a second position which are different from each other in the main scanning direction, changes in said output value that are caused by a lower edge of said medium to be printed blocking said light;

the printing apparatus obtains the position of either one of the left edge or the right edge of said lower edge that is fed trailing the other in said feeding direction based on a position, in the main scanning direction, of said first position, a position, in the main scanning direction, of said second position, and an amount of said medium to be printed fed from when a change in said output value is detected at said first position until when a change in said output value is detected at said second position;

before moving said light-emitting means and said light-receiving sensor from said first position:

by making said medium to be printed stationary and moving said light-emitting means in the main scanning direction, the printing apparatus detects a change in said output value of said light-receiving sensor that is caused by said light, which is emitted by said light-emitting means, passing across an edge of said medium to be printed to specify the position of said edge;

the printing apparatus feeds said medium to be printed with said feeding means after specifying the position of said edge;

by making said medium to be printed stationary and moving said light-emitting means in the main scanning direction, the printing apparatus again detects a change in said output value of said light-receiving sensor that is caused by said light, which is emitted by said light-emitting means, passing across an edge of said medium to be printed to specify the position of that edge; and based on the positions of the two edges that have been specified, the printing apparatus determines which of either the left edge or the right edge of said lower edge is fed trailing in said feeding direction; and based on a result of the determination, the printing apparatus determines whether to set said second position downstream or upstream in the main scanning direction with respect to said first position.

22. A method for determining a lower edge of a medium to be printed with a printing apparatus that is provided with:

feeding means for feeding, in a predetermined feeding direction, a medium to be printed that has been supplied;

light-emitting means for emitting light; and a light-receiving sensor for receiving light emitted by said light-emitting means, the printing apparatus being capable of detecting a change in an output value of said light-receiving sensor that is caused by said medium to be printed, which has been fed by said feeding means, blocking the light, which has been emitted by said light-emitting means, the method for determining the lower edge of the medium to be printed comprising:

a step of detecting, at a plurality of positions, changes in said output value that are caused by the lower edge of said medium to be printed blocking said light; and a step of obtaining a position, in said feeding direction, of either one of a left edge or a right edge of said lower edge that is fed trailing the other in said feeding direction, based on a result of the detection.

23. A computer program for causing a printing apparatus that is provided with: feeding means for feeding, in a predetermined feeding direction, a medium to be printed that has been supplied; light-emitting means for emitting light; and a light-receiving sensor for receiving light emitted by said light-emitting means, and that is capable of detecting a change in an output value of said light-receiving sensor that is caused by said medium to be printed, which has been fed by said feeding means, blocking the light, which has been emitted by said light-emitting means, to detect, at a plurality of positions, changes in said output value that are caused by a lower edge of said medium to be printed blocking said light; and to obtain a position, in said feeding direction, of either one of a left edge or a right edge of said lower edge that is fed trailing the other in said feeding direction, based on a result of the detection.

24. A computer system comprising:

a computer unit; and a printing apparatus that is connectable to said computer unit, the printing apparatus being provided with: feeding means for feeding, in a predetermined feeding direction, a medium to be printed that has been supplied; light-emitting means for emitting light; and a light-receiving sensor for receiving light emitted by said light-emitting means, and the printing apparatus being capable of detecting a change in an output value of said light-receiving sensor that is caused by said medium to be printed, which has been fed by said feeding means, blocking the light, which has been emitted by said light-emitting means, wherein the printing apparatus detects, at a plurality of positions, changes in said output value that are caused by a lower edge of said medium to be printed blocking said light, and based on a result of the detection, the printing apparatus obtains a position, in said feeding direction, of either one of a left edge or a right edge of said lower edge that is fed trailing the other in said feeding direction.

25. A printing apparatus, comprising:

a feeding unit adapted to feed, in a feeding direction, a print medium having leading and trailing edges with respect to the feeding direction, and left and right corners on the side of the leading edge;

a sensor adapted to output a sensor output value based on an amount of sensed light; and a controller adapted to determine, based on a plurality of positions of the leading edge and changes in the sensor output value, a position of the leading one of the left and right corners.

26. The printing apparatus as set forth in claim 25, wherein the controller determines the position of the leading one of the corners by:

detecting one position of the leading edge, based on a change in the sensor output value;

causing movement of the sensor in a main scanning direction;

causing movement of the print medium in the feeding direction;

detecting an other position of the leading edge; and calculating the position of the leading one of the corners using:

the one and the other positions of the leading edge, and a distance of movement, of the print medium, between the detection of the one and the other positions of the leading edge.

27. The printing apparatus according to claim 25, further comprising a print head for forming dots on the print medium.

28. The printing apparatus according to claim 27, wherein the sensor and the print head are both provided on the same movable member.

29. The printing apparatus according to claim 27, wherein the controller carries out printing on the print medium only after feeding the leading one of the left and right corners to a position based on the location of nozzles of the print head.

30. The printing apparatus according to claim 25, wherein the controller carries out borderless printing with respect to an entire surface of the print medium.

31. The printing apparatus according to claim 25, wherein:

the controller is further adapted to determine, based on a plurality of positions of the trailing edge and changes in the sensor output value, a position of the trailing one of the left and right corners on the side of the trailing edge.

* * * * *